US012466640B1

(12) United States Patent
Westmoreland, III

(10) Patent No.: US 12,466,640 B1
(45) Date of Patent: Nov. 11, 2025

(54) STORAGE VESSEL MONITORING SYSTEMS AND METHODS

(71) Applicant: Aubrey Dare Westmoreland, III, Marshall, TX (US)

(72) Inventor: Aubrey Dare Westmoreland, III, Marshall, TX (US)

( * ) Notice: Subject to any disclaimer, the term of this patent is extended or adjusted under 35 U.S.C. 154(b) by 0 days.

(21) Appl. No.: 18/763,978

(22) Filed: Jul. 3, 2024

(51) Int. Cl.
*B65D 90/10* (2006.01)
*B65D 90/22* (2006.01)
*B65D 90/48* (2006.01)

(52) U.S. Cl.
CPC ..... *B65D 90/22* (2013.01); *B65D 90/10* (2013.01); *B65D 90/48* (2013.01)

(58) Field of Classification Search
CPC ..... B65D 90/22; B65D 90/10; B65D 90/48
USPC ..... 220/745, 263, 203.29
See application file for complete search history.

(56) References Cited

U.S. PATENT DOCUMENTS

| | | | | |
|---|---|---|---|---|
| 5,570,714 | A * | 11/1996 | Magish | B65D 90/44 137/213 |
| 5,714,694 | A | 2/1998 | Diessner | |
| 8,667,977 | B1 * | 3/2014 | McCaul | F04F 1/18 244/135 R |
| 9,296,530 | B2 | 3/2016 | Cockerham | |
| 9,764,893 | B1 | 9/2017 | Westmoreland | |
| 11,662,063 | B2 * | 5/2023 | Bollinger | F17C 13/025 220/212 |
| 2002/0190068 | A1 | 12/2002 | Sisk | |
| 2010/0200307 | A1 | 8/2010 | Toms | |
| 2013/0264341 | A1 | 10/2013 | Cockerham | |
| 2014/0116402 | A1 | 5/2014 | Horiba | |
| 2015/0028039 | A1 * | 1/2015 | Kircher | B60K 15/03 220/592.27 |
| 2015/0040517 | A1 | 2/2015 | Furuse | |
| 2015/0362394 | A1 | 12/2015 | Shimoyama | |
| 2016/0001935 | A1 | 1/2016 | Smith | |
| 2016/0288994 | A1 | 10/2016 | Lorenzen | |
| 2017/0138498 | A1 | 5/2017 | Kayser | |
| 2022/0136656 | A1 * | 5/2022 | Clarke | F17C 13/002 220/560.12 |
| 2023/0145243 | A1 | 5/2023 | Oren | |
| 2023/0250923 | A1 * | 8/2023 | Mercer | F17C 1/16 220/582 |

FOREIGN PATENT DOCUMENTS

| | | |
|---|---|---|
| CN | 208795621 | 4/2019 |
| DE | 102011119310 | 5/2013 |
| DE | 10 2011 056 835 A | 6/2013 |

* cited by examiner

*Primary Examiner* — Jacob K Ackun
(74) *Attorney, Agent, or Firm* — Alan R Loudermilk

(57) ABSTRACT

The present invention is directed to a device and system for monitoring the closure state of a hatch on a storage vessel and preferably sensing leak and vent conditions of VOCs or other gases escaping from the storage vessel via the hatch. A pressure sensor senses internal gaseous pressure of the storage vessel, whether positive pressure or vacuum. One or more pressure or force sensors sense force indicative of hatch open, hatch closed, and hatch closed and latched conditions. A monitoring unit receives or generates data based on inputs from the sensors. Estimates or calculations of amounts of gases leaked or vented from the hatch are determined by the monitoring unit. Various alarms and other outputs may be provided. Various force sensor/spring combinations may be employed.

20 Claims, 23 Drawing Sheets

STORAGE VESSEL MONITORING SYSTEMS AND METHODS

BACKGROUND OF THE INVENTION

The present invention is related to storage vessels (such as storage tanks) and systems used for containing liquids having volatile organic compounds or liquids or other substances otherwise producing vapors or gaseous material that may enter the environment, an example being petrochemical liquids with gaseous methane being released or produced in a storage tank.

More particularly, the present invention is related to systems and methods adaptable for access hatches for inspecting and sampling the liquids contained within a storage tank, although applications of embodiments of the present invention extend beyond storage tanks as will be understood from the description herein.

A storage vessel or tank (referred to alternatively throughout as a tank, stock tank or storage tank) for containing liquids may be of any type, terrestrial, marine, rail or truck and constructed of virtually any industrial material, steel, fiberglass and plastic being the most common. Storage tanks intended for containing liquid hydrocarbons (oil, crude oil, refined products, drip gas, etc.) that may produce volatile organic compounds (VOCs) are typically constructed of steel or fiberglass. As used herein, volatile organic compounds include methane, although some definitions of VOC used in other contexts may not include methane.

Most tanks exhibit generic design features, such as that depicted in FIG. 1. These include the tank exterior shell 101 having continuous sides, floor and roof (some designs employ floating external or internal roofs) for containing liquid 110 in its interior, while preventing harmful VOCs 114 from being released or vented into the atmosphere. Liquids 110 are piped into the interior of tank 100 through inlet pipe 106 and drained from tank 100 through outlet pipe 108. Liquid 110, most often a hydrocarbon based fluid, such as crude oil and refined products or produced water, emit VOCs 114 into the tank volume above the surface 112. One or more VOC recovery systems 105 recover VOCs 114 as they are emitted from fluid 110. VOCs 114 exit tank 100 from a pipe opening in the roof (which may be stationary, floating or have both) and into a closed conduit connected to a recovery apparatus of some type. Additionally, emergency vent 104 is provided on the roof for venting VOCs 114 into the VOC recovery system (or the atmosphere as shown) for the case of a rapid buildup of pressure within the interior tank 100 not handled by VOC recovery system 105. Finally, disposed on the roof of tank 100 is a manhole or access hatch, enabling tank operators to gain access to liquid 110. Generically, these hatches are known in the petroleum industry as "thief hatches" because they enable tank operators to visually inspect and gauge the contents of tank 100, as well as "thief" or sample the liquid stored within.

The EPA has identified thief hatch misuse as a major contributor for the unchecked release of VOCs into the atmosphere. In fact, several state environmental agencies have dubbed thief hatches as the weakest link of VOC control and mandated specific thief hatch monitoring and management. Misuse occurs in a number of ways. First, obviously, by tank operators leaving the thief hatch open following thiefing operations. Second, and much less conspicuous, is by leaving the thief hatch closed, but unlatched. Generally, unless "dead weighted", thief hatches are relatively light weight and will not substantially reduce the flow of VOCs into the atmosphere unless the lid is securely latched to its base.

Another form of hatch misuse is related to thief hatch maintenance. Poor maintenance practices and standards are a major contributing factor to VOC leakage. While leaks can occur due to sealing ring wear or failure on the base flange and/or hatch cover, vacuum plate damage, pressure or vacuum compensation spring failure or valve stem or guide wear, by far the most common maintenance related failure involves the pressure or cover gasket (described hereinafter as a pressure gasket, lid cover gasket or merely a cover gasket). The atmospheric seal for a thief hatch for use in the petrochemical industry is provided by a pliable or semi-pliable cover gasket or seal. Typically, cover gaskets for thief hatches are comprised of neoprene, Nitrile, BUNA-N (nitrile) rubber, EPDM rubber (ethylene propylene diene monomer (M-class) rubber), ECH (Epichlorohydrin), PTFE or Viton® (Viton® is a registered trademark and tradename of E.I. DuPont de Nemours and Company, Inc. of Wilmington, Del.). However, other materials may be used as gasket materials depending on the demands of the respective usage; these include, but are not limited to open and closed cell foam and sponge, natural rubber, BUNA-N(nitrile) rubber, BUNA-S rubber, ECH (epichlorohydrin), neoprene rubber, neoprene coated fabrics, EPDM rubber, EPDM sponge, silicone rubber, EVA (ethylene vinyl acetate), polyethylene, polystyrene, polypropylene, polyurethane, polyimide, PVC sponge, vinyl-flexible & rigid, bucote, nicote, steel, stainless steel, cork, cork-rubber compositions, plastics, cloth, cloth inserted rubber and coated fabrics. Due to the design of most thief hatches, the gasket material must have a very low hardness. The quantification of gasket hardness, durometer, is an exceptionally complicated subject and will not be discussed herein, except to mention that the hardness of elastomeric gasket materials is usually described by two parameters: Shore hardness and compression force deflection (CFD). Shore hardness in this context (Shore A) is a measure of how well a material resists a permanent indentation. CFD is a measure of firmness as defined by ASTM standard D1056, as the force necessary to reduce the thickness of a material by 25%). Both Shore A and CFD for thief hatch gasket materials must be low in order to provide a tight seal with relatively low closure force provided by the pressure compensation spring in the pressure/vacuum compensation valve (the design and function of the pressure/vacuum compensation valve system will be discussed below with regard to FIGS. 2 and 3).

In any case, good thief hatch maintenance requires that the thief hatch gasket be in good physical repair and the gasket and corresponding upper and lower sealing rings be free of any contaminants that may inhibit proper sealing. Thief hatch maintenance is difficult to qualify because often the appearance of the gasket and corresponding upper and lower sealing rings is not noteworthy. However, repeated thiefing and gauging operations contribute to the degradation of the gasket and sealing rings. Typically, only a single field gauger climbs onto the tank's roof with a plumb bob, line, sampling thief, thermometer, sample containers, notepad and other tools as needed. The gauger opens the lid of thief hatch 102, drops the plumb bob and checks, verifies and records the fluid level. Next, temperatures are recorded from various depths. Finally, the gauger thiefs samples of fluid from various depths and transfers the samples to corresponding sample containers and records the samples' information. All too often the gauger retrieves the final thief sample, slams the thief hatch lid and latches it with his foot while simultaneously transferring the fluid sample from the thief to the container. Field gaugers travel from one tank to another, pad to pad, and site to site in a rather hectic fashion, gauging/thiefing different tanks at different schedules. Consequently, thief hatch gaskets become worn, torn or deformed from repeated hard lid closings and from contaminates that accumulate on the thief hatch gasket and corresponding lower and upper sealing rings from spillage from line, gauging and thiefing operations, as well as from merely opening and closing the hatch cover as will be discussed below. All of the above contribute to VOC leakage at the pressure gasket.

Improper thief hatch operating has become such an issue that several states now require that only trained field gaugers open thief hatches and that they follow a strict protocol of: verify absence of VOCs; unlatch the thief hatch lid; inspecting lid, valve, gasket and upper and lower sealing rings; perform gauging/thiefing operations; re-inspect lid, valve, gasket and upper and lower sealing rings; cleaning lid, valve, gasket and upper and lower sealing rings; replace thief hatch and valve gaskets as needed; close lid; latch thief hatch lid, verify full engagement of the thief hatch latch and verify absence of VOCs.

FIGS. 2A, 2B, 2C and 2D are oblique, side, top and cross-sectional views of a diagram for a generic thief hatch. Typically, thief hatches 102 comprise four basic components: lid 202 and hatch cover 230 assembly (including upper sealing ring 232 and pressure/vacuum compensation valve mechanism 234), flange base 220 and lower sealing ring 224 assembly, hinge 208 assembly with optional latch 204 with catch 206. Disposed along flange base 220 of thief hatch 102 is a plurality of bolt holes for receiving bolts or studs 226 from the roof of tank 100 over flange gasket 222 (threaded nuts are used in conjunction with studs). Lid 202 and hatch cover casting 230 are two independent assemblies joined together with the pressure/vacuum compensation valve 234, the function of which will be described further below. Lid 202 and hatch cover casting 230 pivot horizontally from flange base 220 via hinge 208 about hinge pin 209 (as can be seen in FIG. 3A). In practice, one leaf of hinge 208 is secured to lid 202, as is catch 206, while the second leaf is secured to flange base 220 and the leaves are hingedly coupled with hinge pin 209.

Generally, in the closed position, lid 202 completely covers flange base 220. Also, upper sealing ring 232 of hatch cover 230 engages lower sealing ring 224 of flange base 220, with lid pressure gasket 210 interposed between the two to provide an air-tight seal. Lid pressure gasket 210 is positioned adjacent to upper sealing ring 232 on hatch cover casting 230 and secured by friction to vertical lip 233 of hatch cover casting 230. Pressure gasket 210 is most often a circular shaped flat seal comprised of a pliable or semi-pliable material as described above. Optionally, lid pressure gasket 210 may have a "U"-shape cross-sectional shape that fits snuggly over the outer edge of upper sealing ring 232 of hatch cover casting 230 (not shown in the figures). While in the closed position, optional latch 204 pivots about latch pin 205 and onto catch 206, thereby latching lid 202 to base flange 220.

In the latched position, latch 204 secures lid 202 to base flange 220 through catch 206 at a force predetermined by pressure compensation spring 235 within pressure/vacuum compensation valve 234, discussed immediately below. Maintaining a constant uniform pressure on lid pressure gasket 210 from hatch cover casting 230 toward lower sealing ring 224 on flange base 220 is key to sealing VOCs within tank 100. Here it should be mentioned that not all thief hatch designs utilize a latching mechanism, some use dead weight of lid 202 for exerting sealing force (pressure) (not shown in the figures). In addition, latch 204 and catch 206 assembly depicted in the figures are merely one exemplary latch, other latch designs employ a "J"-hook, and/or J-hook and cam mechanism or various types of levered cams for amplifying a force between hatch cover casting 230 and flange base 220 (also not shown in the figures).

The force (pressure) exerted on lid pressure gasket 210 from hatch cover casting 230 is predetermined by pressure compensation spring 235 inside pressure/vacuum compensation valve 234. Hatch cover 230 is movably secured to lid 202 through pressure/vacuum compensation valve 234. Pressure/vacuum compensation valve 234 is a means for compensating the internal pressure of tank 100 to near that of the atmosphere to avoid rupturing or imploding the tank's exterior shell 101 (i.e., the tank's walls and roof). Pressure/vacuum compensation valve 234 is cylindrically-shaped and generally comprises a pair of springs which enable each of lid 202 and vacuum plate 239 to move (open) independently of one another in order to compensate for pressure differences between the interior of tank 100 and the atmosphere.

Pressure compensating spring 235, disposed within pressure/vacuum compensation valve 234, forces lid 202 and hatch cover casting 230 apart. In closing lid 202 onto base flange 220, pressure compensating spring 235 is compressed. This exerts a predetermined downward force on lid 202, thereby squeezing lid pressure gasket 210 between the upper surface of lower sealing ring 224 on flange base 220 and the lower surface of upper sealing ring 232 on hatch cover casting 230. Consequently, the magnitude of the sealing force across pressure gasket 210 is determined by the compressive strength of pressure compensating spring 235. In the case of internal pressure within tank 100 increasing, the pressure creates an upward force on the lower surface of hatch cover casting 230 (and vacuum compensation plate 239). Once that upward force exceeds the sealing force created by pressure compensating spring 235, hatch cover casting 230 moves upward relative to lid 202, thereby breaking the seal of pressure gasket 210 and allowing vapors from tank 100 to escape into the atmosphere through lid cover opening 212. Dead weight thief hatches do not use pressure compensating valves for controlling the interior pressure of tank 100, but instead use the dead weight of the lid to provide a predetermined level of sealing force.

Vacuum compensating spring 236 is a compression spring disposed within pressure/vacuum compensation valve 234 and forces vacuum plate 239 and hatch cover casting 230 together. The magnitude of the force is predetermined by the compressive force of vacuum compensating spring 236. In case of a vacuum occurring within tank 100, the atmospheric pressure is greater than the internal pressure of the tank. When the force on the upper surface of vacuum plate 239 (created by the atmospheric pressure reaching vacuum plate 239 through vacuum compensation ports 237 and lid cover opening 212) exceeds the combined force of vacuum compensating spring 236 and the force on the lower surface of vacuum plate 239 created by the internal pressure of tank 100, vacuum plate 239 moves downward relative to lid 202, thereby breaking the seal of vacuum plate seal 240 and allowing air from the atmosphere to enter tank 100 through vacuum compensation ports 237 and from lid cover opening 212. Some dead weight thief designs make use of a vacuum compensating valve to compensate for vacuum conditions within tank 100.

With further regard to latching thief hatches with regard to VOC leakage, such as those exemplary hatches depicted in the figures, these hatches may be understood to operate in three distinct positional or closure states. FIGS. 3A, 3B, and 3C are diagrams depicting the three closure states of a typical thief hatch: open in FIG. 3A; closed in FIG. 3B; and closed and latched in FIG. 3C. One could conclude from the figures that thief hatch 102 of FIG. 3B in the closed position and of FIG. 3C in the closed and latched position are remarkably similar. However, with some hatch designs (and depending on the compressive strength of pressure compensating spring 235) lid 202 will be slightly skewed from flange base 220, as is apparent from the position of lid 202 in FIG. 3B. This is often very slight and virtually impossible to recognize from any vantage point except a direct side view. However, as a practical matter, in the closed (but not latched position) these hatches are actually open and not sealed. Only a small portion of pressure gasket 210 is actually in contact with lower sealing ring 224 of base flange 220, leaving the remaining circumference of pressure gasket 210 unsealed and open to the atmosphere.

FIGS. 3D and 3E are cross sectional views of thief hatch 102 with lid 202 closing (or opening) onto base flange 220 which better depicts the movement of pressure/vacuum compensation valve 234 during opening and closing of lid 202. By design, the lowermost portion of pressure/vacuum compensation valve 234, including vacuum plate 239, extends beyond the lower edge of lid 202 whenever lid 202 is closed as can be seen in FIG. 2D, where thief hatch 102 is depicted in the closed position. However, in the open position, upper sealing ring 232, lid pressure gasket 210 and vertical lip 233 of hatch cover 230 all extend beyond the lower edge of lid 202 as can be understood by comparing thief hatch 102 depicted in FIG. 2D, in the closed position, with thief hatch 102 depicted in FIG. 3A, with thief hatch 102 in the open position.

More importantly for understanding the need for embodiments of the present invention, as lid 202 closes about hinge 208, initially lid pressure gasket 210 contacts lower sealing ring 224 of base flange 220 only at a point nearest to hinge 208, see FIG. 3D. At that position, pressure compensation spring 235 is fully extended. As lid 202 continues to close about hinge 208, lid pressure gasket 210 continues its bias against lower sealing ring 224, which gradually compresses pressure compensation spring 235 (compare pressure compensation spring 235 in FIG. 3D with that in FIG. 3E). Importantly, the lower surface of lid pressure gasket 210 scrapes along the upper surface of lower sealing ring 224 while exerting closing force to pressure/vacuum compensation valve 234 until pressure/vacuum compensation valve 234 is in its uppermost position (see FIG. 2D) and lid 202 is fully closed. This closing process takes a toll on lid pressure gasket 210. To be sure, the above-described phenomenon is not an uncommon occurrence with hatches or other types of doors with seals, such as home entry doors. In certain critical applications, such as pressurized aircraft fuselage doors, the hatch uses an interlocking hinge system that first allows the hatch to swing into the closing position without the door seal contacting the frame, and then the hinges, hatch and door seal move parallel to and mates with the frame in unison, thereby eliminating friction on the door seal.

However, with regard to most thief hatch usage, stress on the portion of lid pressure gasket 210 closest to hinge 208 is even more pronounced because that part of lid pressure gasket 210 is the support member that absorbs all of the biasing force necessary to compress pressure compensation spring 235 through the range of closing angles-compare lid 202 in FIGS. 3A, 3D, 3E, and 2D. The closing/opening forces have an even more dramatic wear effect on gasket 210 due to the low durometer of the gaskets used in thief valves. Additionally, as is apparent from the figures, the moving components of pressure/vacuum compensation valve 234 are subject to accelerated wear because the closing force is not applied parallel to the movement direction of hatch cover 230. Consequently, aside from the inherent problems associated with closing and latching a thief hatch, VOC leakage from mechanical failure is also very prevalent.

Although VOC leakage from mechanical failures happens, the far more pervasive, as well as correctable problems, are hatch closure issues. Clearly, operators can easily mistake a closed thief hatch for a closed and latched thief hatch (as demonstrated by the views in the previous figures). It is often even more difficult to distinguish merely closed from closed and latched with other latch designs, such as those where the latch extends downward from the thief hatch lid, because pressure gasket 210 is not fully in place with lid 202 merely closed. For those designs, the latch automatically falls into a nearly latched position by closing the hatch, often an operator must wiggle the latch to determine whether or not it is actually engaged with the latch catch. Very importantly, however, a closed but not latched thief hatch can leak VOCs at substantially at same rate as that of a thief hatch in the open position. Hence, even though a closed thief hatch appears similar to a closed and latched thief hatch, for the purposes of VOC abatement, a closed thief hatch is actually much more similar in operation to an open thief hatch. Consequently, recent efforts have been made to verify that a thief hatch is actually, truly latched and not merely closed.

The prior art has dealt with the problem of securing thief hatches by employing various sensors to detect the position of the thief hatch lid. The detector is often connected to a light or audible alarm for alerting operators when the thief hatch lid is open. For example, an adjustable, normally closed (momentary off) door plunger switch 402, as depicted in FIG. 4A closes the alarm circuit when the thief hatch lid is open. Plunger switch 402 comprises mounting hardware (not shown), body 404 containing the switch contacts and spring, plunger 408 and plunger adjustment 406 for adjusting the vertical height of plunger 408 in the electrically open state. Typically, plunger switch 402 mounts to flange base 220 directly below an edge of thief lid 202 and the height of plunger 408 is adjusted to the electrically open state with thief hatch lid 202 fully closed as depicted in FIG. 4B, but electrically open state with thief hatch lid 202 in any state except fully closed, see, for example, FIG. 4C.

Adjusting the correct operating height of plunger 408 is critical to its proper operation. Additionally, for maximum effectiveness, plunger switch 402 must be located opposite the hatch hinges, near latch 204. In this position, plunger switch 402 is highly vulnerable to being jolted and bumped during gauging and thiefing operations. In any case, while this prior art mechanism will alert the operator to an open thief hatch, it generally cannot distinguish between a thief hatch that is merely closed, from one that is completely latched.

What was needed was a sensor that detects the position of thief hatch latch 204, not merely the position of thief hatch lid 202. One mechanism for sensing the proper latch position known in the prior art is, for example, a normally open reed switch 502, as depicted in FIG. 5A. Reed switch 502 comprises mounting hardware (not shown), body 504 containing reed switch contacts (also not shown) with a ferric arm attached to one reed contact and magnet 506. Whenever the ferric arm inside body 504 is proximate to magnet 506, the magnet attracts the ferric arm, causing the attached reed contact to close on a second internal contact, thus completing an electrical circuit. Typically, reed switch body 504 is mounted to flange base 220 in a position proximate to the position of thief hatch latch 204 when fully engaged with latch catch 206, see FIGS. 5B and 5C. Magnet 506 is then attached to thief hatch latch 204 at a position closest to body 504 with thief hatch latch 204 fully engaged with latch catch 206. Here, rather than the switch circuit closing with the position of thief hatch lid 202, the reed contacts close the alarm circuit whenever magnet 506 attached to thief hatch latch 204 is proximate to body 504, that is whenever thief hatch latch 204 engages latch catch 206.

Other reed switch sensors for "J" latch designs use a pair of pins, one for catching and the other as a hinge pin for the J hook. With those, the pins are modified, the catch with an internal magnet and the hinge pin for the J hook is supplied with a reed switch as the one described above. This type "J" latch is easily modified for a lid position sensor by merely replacing the original catch and J hook hinge pin with the modified components.

This type of sensor overcomes the shortcoming of the prior art sensor's inability to distinguish between a closed thief hatch and a closed and latched thief hatch. However, reed switch 502 only senses the position of thief hatch latch 204. It is possible for the latch's position to mimic the fully engaged position without thief hatch lid 202 being fully latched or in some cases, even being closed. Furthermore, reed switch 502 is also mounted at the latch in the front, at the working area of the thief hatch, thereby also being vulnerable to being jolted and bumped during gauging and thiefing operations. Furthermore, no prior art mechanism provides any information as to the mechanical condition of the pressure seal.

What is needed is a mechanism for correctly detecting the closure state of thief hatch lid 202, one which can accurately distinguish between a thief hatch lid that is closed and latched from one that is merely closed. Also, what is needed is a mechanism/method for determining at what point venting begins, namely when the internal tank pressure begins to overcome the spring force on pressure gasket 210. This point of vent cannot be determined by the hatch lid position as discussed above. Additionally, a mechanism/method that can also be used to determine baseline parameter values for a correctly functioning thief hatch would be very advantageous. The values of those parameters could then be monitored and compared to the baseline values of the parameters to determine the condition of the thief hatch. The greater the deviation of the monitored values from the baseline parameter values, the greater the risk of VOC leakage from the thief hatch. In addition to thief hatch closure status, also what are needed are systems and methods in which a pressure sensor is provided such that gaseous emissions vents can be estimated or determined. Generally herein, a vent is referring to the release or flow of gas caused by the internal tank pressure overcoming the spring force on pressure gasket 210, with a leak generally referring to gas release caused by improper operation, mechanical failure or other unintended condition/operation of the hatch.

What also is needed are improved mechanisms to determine the status of springs, whether in tension or compression.

BRIEF SUMMARY OF THE INVENTION

The present invention is related to verifying the closure state of a hatch, and preferably estimating or determining the amount of VOCs or other gases released or vented from the storage tank or other vessel. A force sensor may be positioned between the upper sealing ring of the hatch lid and the lower sealing ring of the flange, adjacent to the pressure gasket. In the opened position, the force sensor detects little force between the upper and lower sealing rings, and in the closed position, the sensors detects an increase in force, but in the closed and latched position, the force sensor detects much higher force between the upper and lower sealing rings. In preferred embodiments, the force sensor is positioned to detect pressure from a spring and not between sealing surfaces. The position of hatch cover casting 230 determines a vent as a result of spring pressure on the gasket being overcome by the tank pressure. In other preferred embodiments, an internal pressure/vacuum sensor provides data to measure/calculate the amount of gases vented and flow rates as well as to determine if there is vacuum condition with the tank.

The force sensor is electrically coupled to a monitor unit that delivers power to the sensor and communicates data determined from the force readings (either as raw or processed data) to a remote location such as data/processing remote centers, clouds, or portable devices. Cry-out alarms may be employed to alert operators when a hatch is open or not securely latched. Other alarms may be employed to provide alerts based on vent conditions and flow rates, for example.

In yet other preferred embodiments, force sensors are used to determine the status of springs in compression or tension in a wide variety of applications.

BRIEF DESCRIPTION OF THE SEVERAL VIEWS OF THE DRAWINGS

The novel features believed characteristic of the present invention are set forth in the appended claims. The invention itself, however, as well as preferred modes of use, further objectives and advantages thereof, will be best understood by reference to the following detailed description of an illustrative embodiment when read in conjunction with the accompanying drawings wherein:

Figure 1:
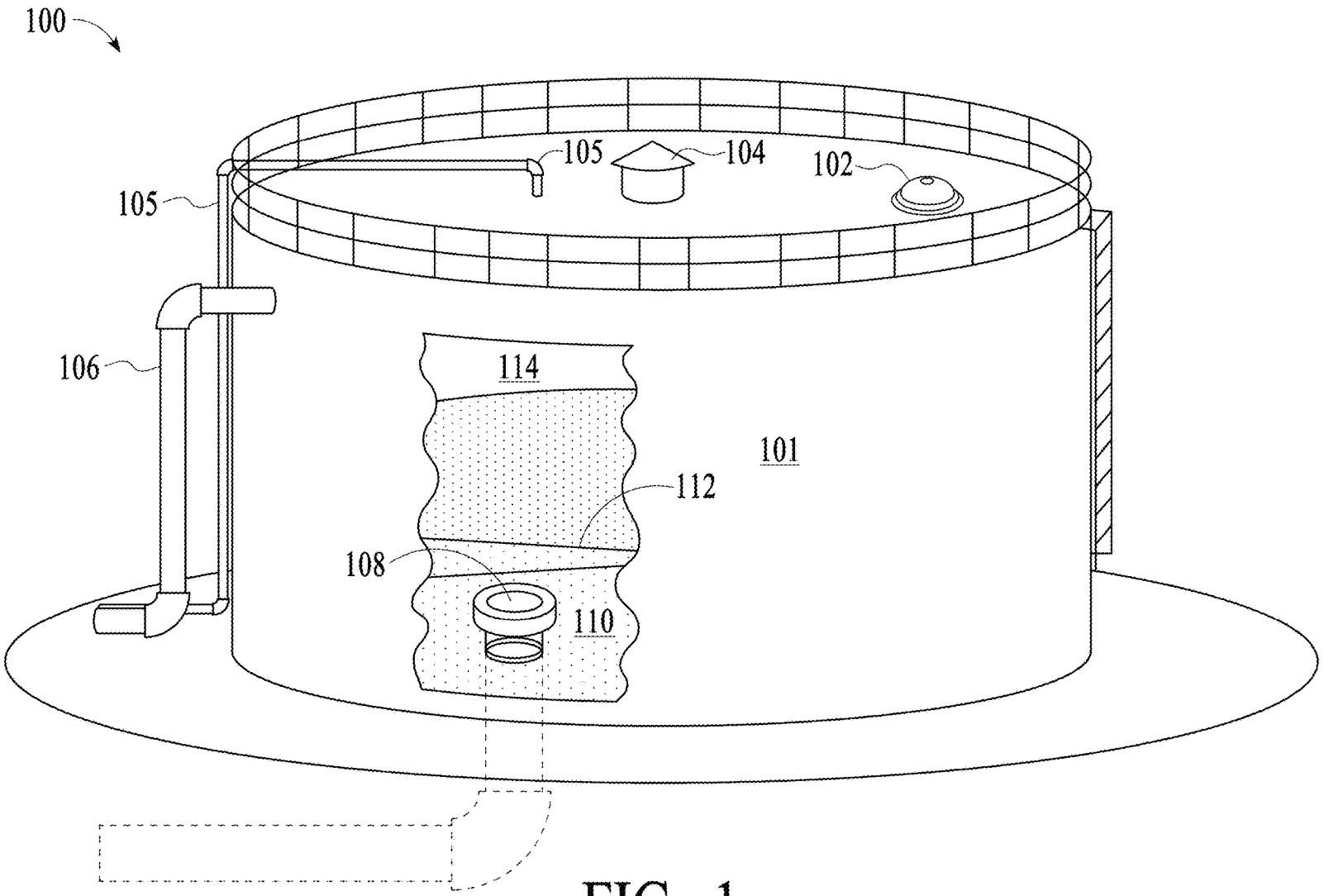
FIG. 1 (PRIOR ART)
FIG. 1 is a diagram of a generic terrestrial tank as typically used in the petroleum industry.
Figure 2A:
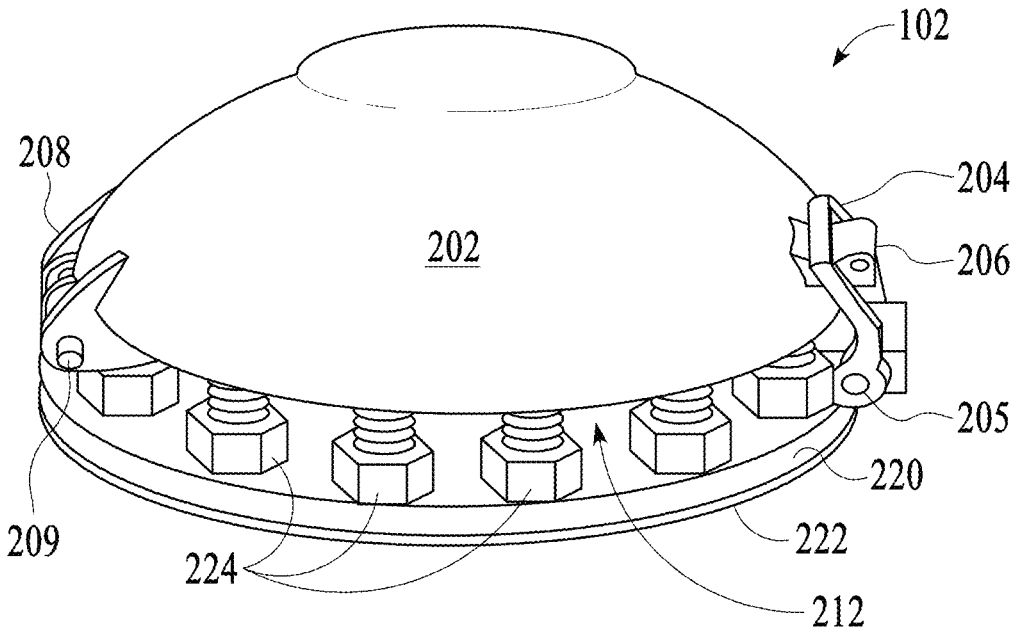
FIG. 2A (PRIOR ART)
FIGS. 2A, 2B, 2C and 2D are oblique, side, top and cross-sectional views of a generic thief hatch.
Figure 2B:
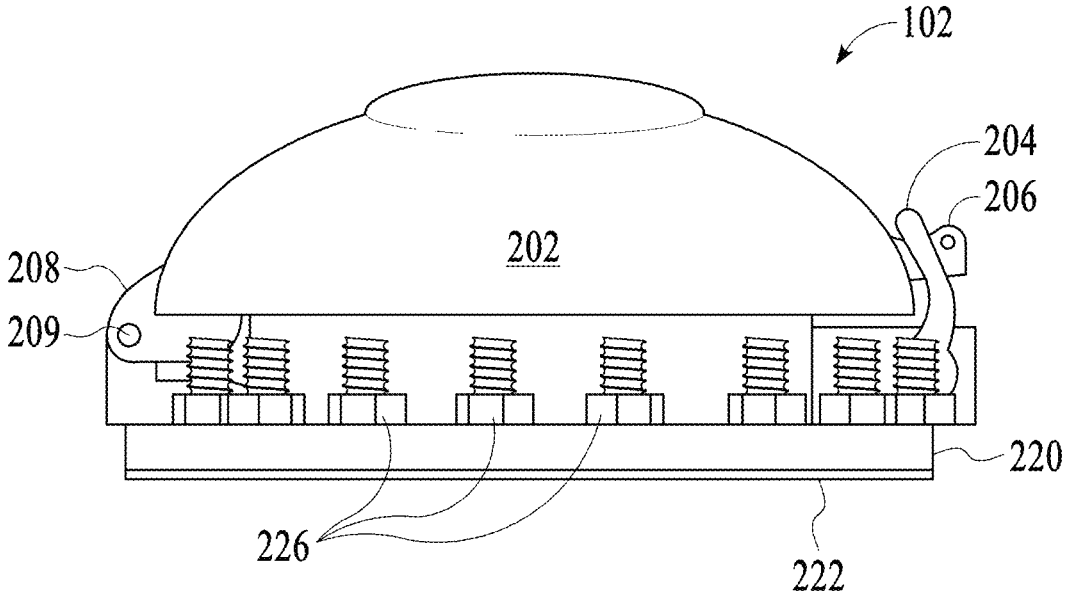
FIG. 2B (PRIOR ART)
Figure 2C:
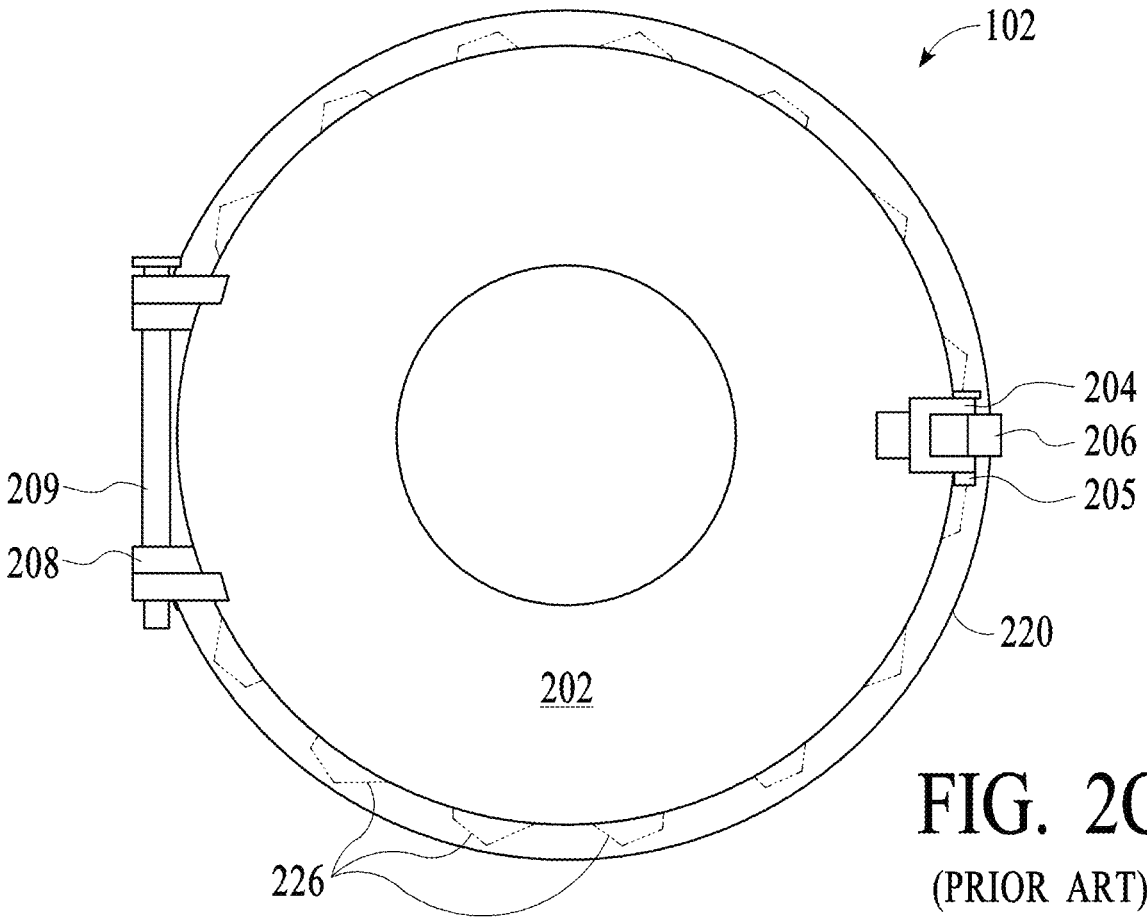
FIG. 2C (PRIOR ART)
Figure 2D:
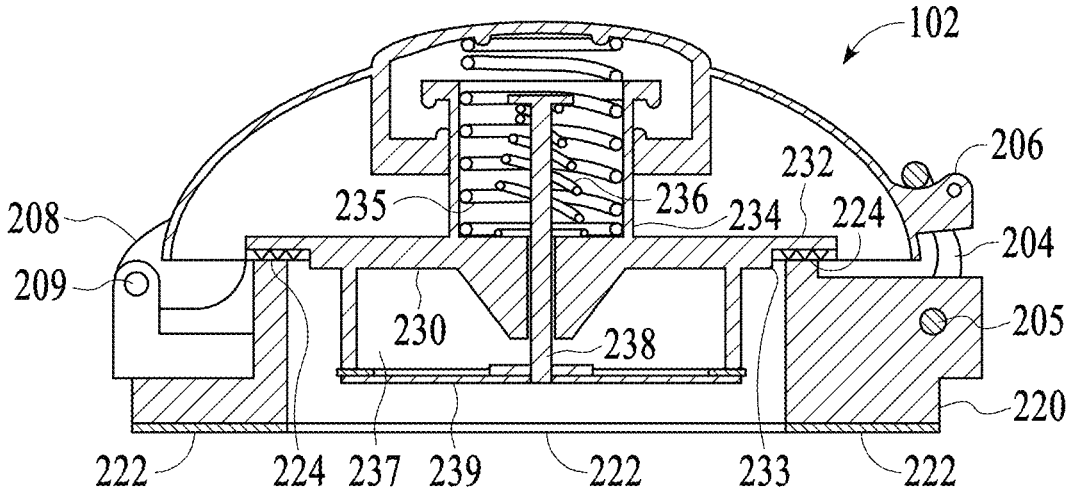
FIG. 2D (PRIOR ART)
Figure 3A:
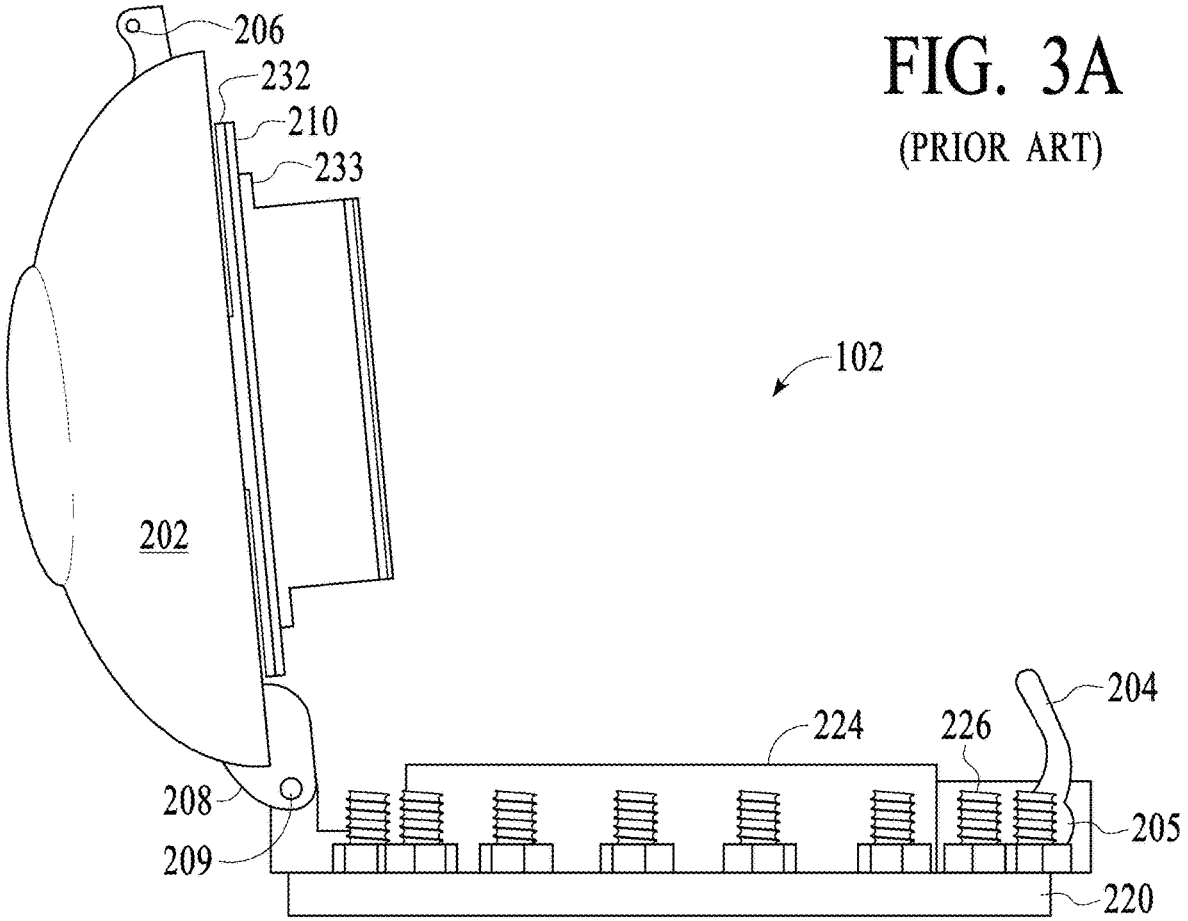
FIG. 3A (PRIOR ART)
FIGS. 3A, 3B, 3C, 3D and 3E are diagrams depicting the three closure states of a typical thief hatch: open in FIG. 3A; closed in FIG. 3B; closed, latched in FIG. 3C; and two intermediated closing states in FIGS. 3D and 3E.
Figure 3B:
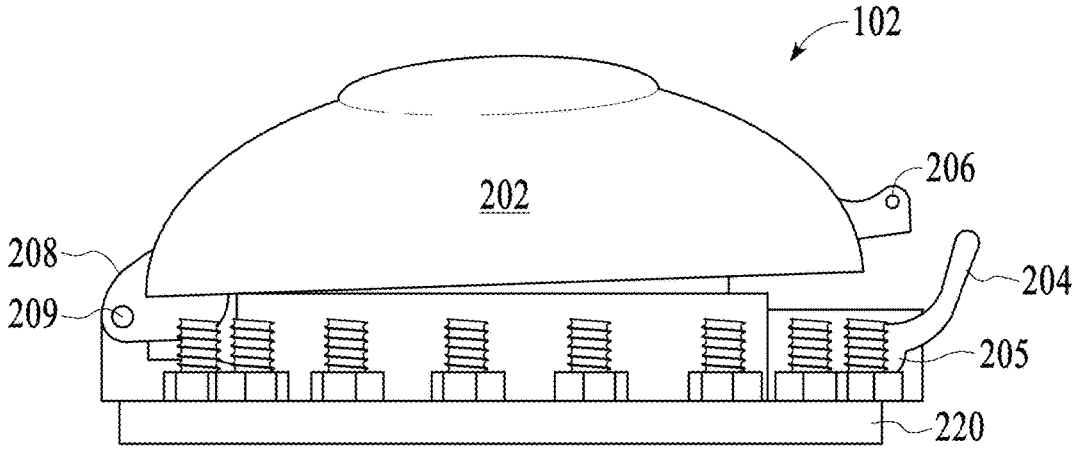
FIG. 3B (PRIOR ART)
Figure 3C:
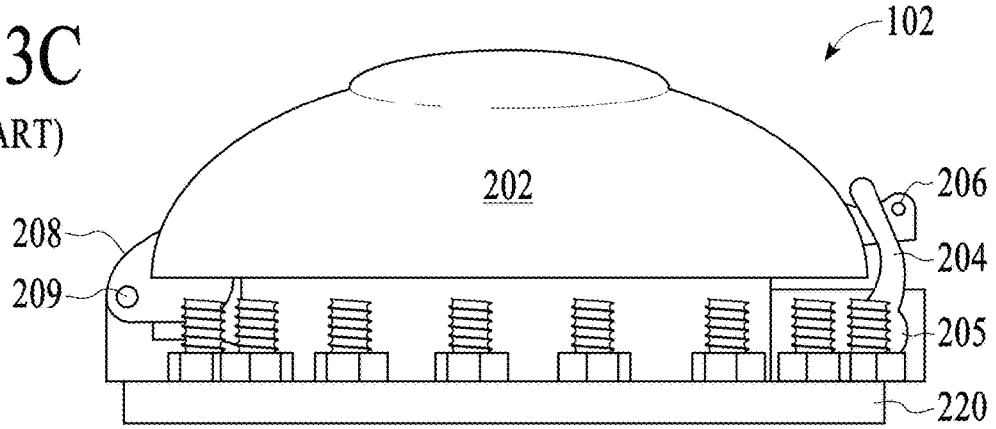
FIG. 3C (PRIOR ART)
Figure 3D:
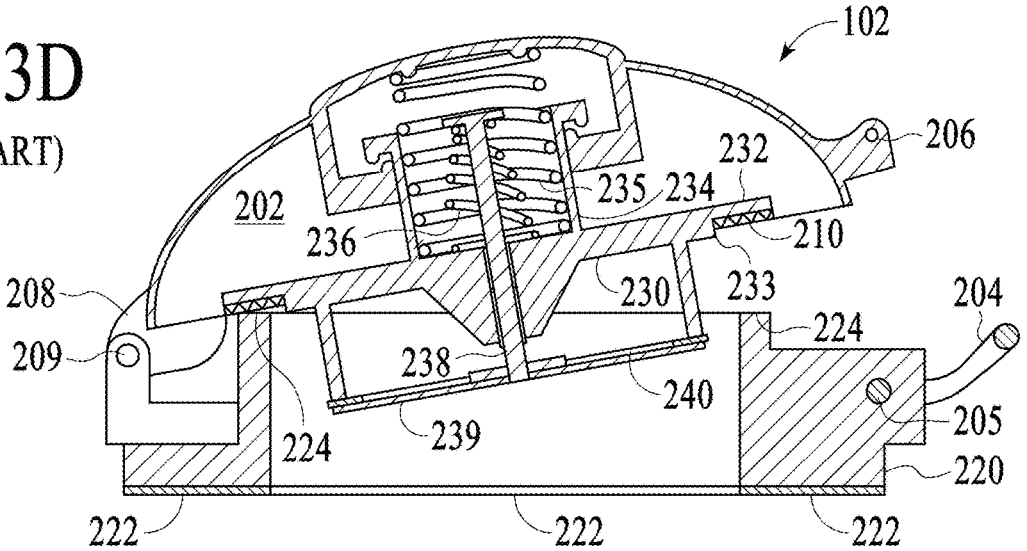
FIG. 3D (PRIOR ART)
Figure 3E:
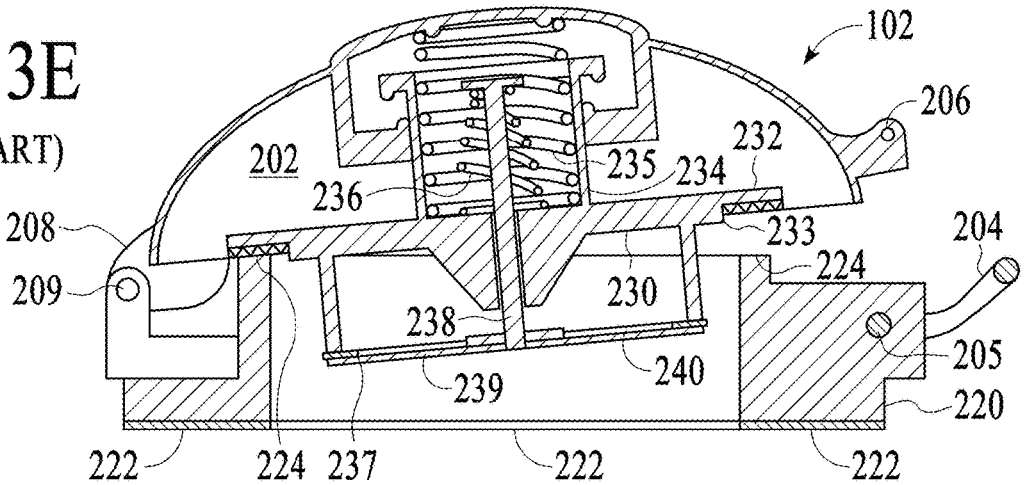
FIG. 3E (PRIOR ART)
Figure 4A:
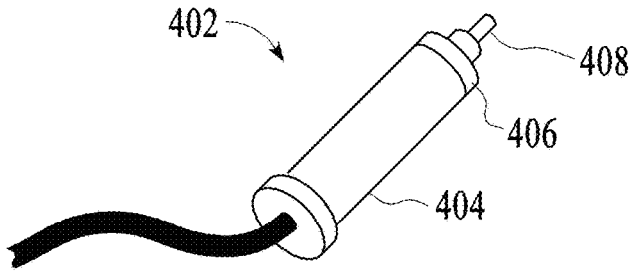
FIG. 4A (PRIOR ART)
FIG. 4A is a diagram depicting a normally closed (momentary off) door plunger switch and FIGS. 4B, and 4C depict diagrams of the plunger switch implemented on a thief hatch, in the closed and latched position (FIG. 4B) and open position (FIG. 4C), as known in the prior art.
Figure 4B:
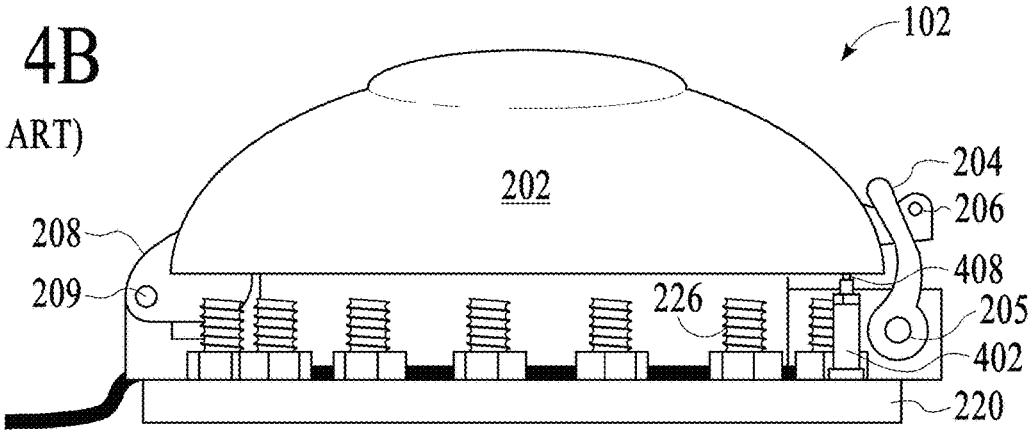
FIG. 4B (PRIOR ART)
Figure 4C:
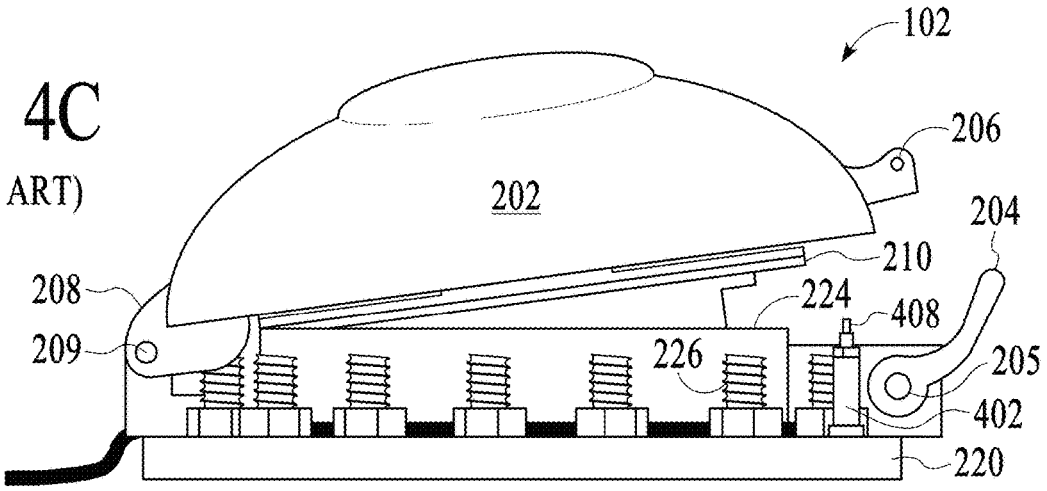
FIG. 4C (PRIOR ART)
Figure 5A:
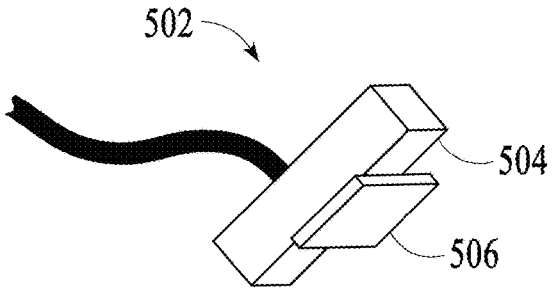
FIG. 5A (PRIOR ART)
FIG. 5A is a diagram depicting a normally open magnet reed switch and FIGS. 5B, and 5C depict diagrams of the reed switch implemented on a thief hatch, in the closed and latched position (FIG. 5B) and open position (FIG. 5C), as known in the prior art.
Figure 5B:
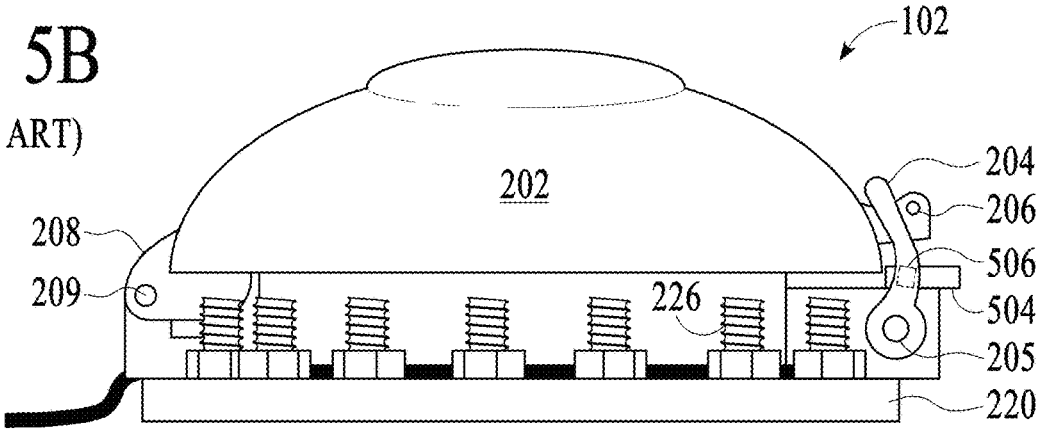
FIG. 5B (PRIOR ART)
Figure 5C:
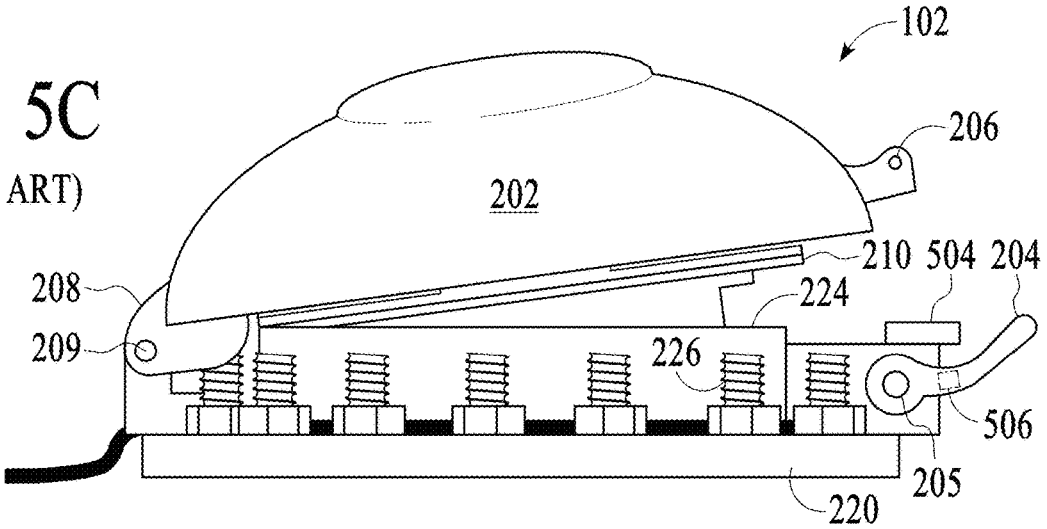
FIG. 5C (PRIOR ART)

Other features of the present invention will be apparent from the accompanying drawings and from the following detailed description.

DETAILED DESCRIPTION OF THE INVENTION

In the following description, reference is made to the accompanying drawings that form a part hereof, and in which are shown by way of illustration, specific embodiments in which the invention may be practiced. These embodiments are described in sufficient detail to enable those skilled in the art to practice the invention, and it is to be understood that other embodiments may be utilized. It is also to be understood that structural, procedural and system changes may be made without departing from the spirit and scope of the present invention. The following description is, therefore, not to be taken in a limiting sense. For clarity of exposition, generally speaking like features shown in the accompanying drawings are indicated with like reference numerals and similar features as shown in alternate embodiments in the drawings are indicated with similar reference numerals.

The U.S. Environmental Protection Agency (EPA) has defined VOCs as any "compound of carbon, excluding carbon monoxide, carbon dioxide, carbonic acid, metallic carbides or carbonates, and ammonium carbonate, which participates in atmospheric photochemical reactions," and has identified exceptions for compounds "determined to have negligible photochemical." With regard to the storage of hydrocarbons, the EPA, as well as many state environmental agencies, have promulgated rules regarding the unchecked emission of VOCs into the atmosphere. These rules pertain to: limitations on the landing of floating roof tanks; testing, inspection and monitoring requirements of tanks; the control of flash emission from fixed roof storage tanks; and specific requirements for tank fittings, seals and hatches for eliminating the leakage or uncontrolled release of VOCs.

While these compounds are harmful to the environment, they are relatively easy for agency inspectors to detect escaping from a storage tank. Using IR (infrared) imaging, VOC emissions and other VOC leaks can be detected instantaneously from pipes, pipelines, fittings, hatches, vents, valves and other components normally associated with the transportation and storage of VOC emitting compounds. Moreover, IR imaging devices are relatively inexpensive, readily available, generally foolproof and create a digital record of a VOC emission event. Handheld IR imaging devices are in widespread use by agency regulators, environmental watch dogs and even private citizens. Recently, a citizens' groups comprised mainly of retirees in Lehigh Acres, Fla., purchased very inexpensive optical filters for their smartphones and created digital records of alleged VOC emission violations that spurred the state's environmental protection agency to more actively monitor VOCs.

Furthermore, state and federal agencies have used various techniques in deploying these IR imaging devices. Portable IR imaging devices are issued or available to most field agents for overt and covert site inspections. Larger and more sensitive IR imaging devices are deployed in aircraft and satellite IR imaging is being investigated. Fixed-site IR units are currently being deployed at tank farms, pump stations, trucking, rail and marine terminals and virtually anywhere an agency perceives a need and can get a consent agreement or mandatory authorization associated with site permitting for provisioning. Site operators are increasingly employing their own IR imaging devices for monitoring and abating VOC emissions. This technology, however, is not as valuable for the operators because the technology merely makes a record of VOC emissions and does little in the way of proactive abatement, and also because the operators' own IR digital records can often be used as evidence against them. The problem is not merely academic; some states, such as Colorado, have promulgated fines of up to $17,000.00 per day, per VOC emission violation event.

While VOC emission and leaks may occur at many points along the production and transmission circuit, emission from hatch covers are particularly problematic. This is so because thief hatch leaks and vents tend to emit a large volume of VOCs in a short period of time, they rarely result from a component failure such as a cracked pipe or seal and, most importantly, because they are virtually all the result of human error and, therefore, nearly 100% preventable. What is needed is a reliable in-situ mechanism for accurately detecting the closure state of a thief hatch (open, closed or closed and latched), suitable for virtually any thief hatch design (as well as other generic hatch designs), uncomplicated to install, inexpensive to procure and operate and that automatically monitors hatch closure events in the background with minimal human intervention. Also what is needed are improved mechanisms for measuring pressure/vacuum and being able to estimate/calculate the amount of emissions vented from tanks and other storage vessels.

In accordance with an exemplary background embodiment of the presently described invention, a device and system are disclosed for automatically monitoring the closure state of a thief hatch (open, closed or closed and latched), in real time, as well as monitoring inferences to the condition of the thief hatch and associated pressure valve. The presently described background device/system is suitable for use with virtually any thief hatch design (as well as other generic hatch designs), and it is uncomplicated, easy to install, inexpensive to procure and operate, and automatically monitors hatch closure events with minimal human intervention. In sharp contrast with prior art hatch lid position sensors, the presently described background invention monitors the force applied to the thief hatch lid 202, through hatch cover casting 230, and on to lower sealing ring 224 of the base flange 220 across the pressure gasket 210, without compromising the sealing capabilities of the pressure gasket 210. In certain preferred embodiments, improved mechanisms using force sensors are used for determining spring status and, for example, hatch status.

Figure 6A:
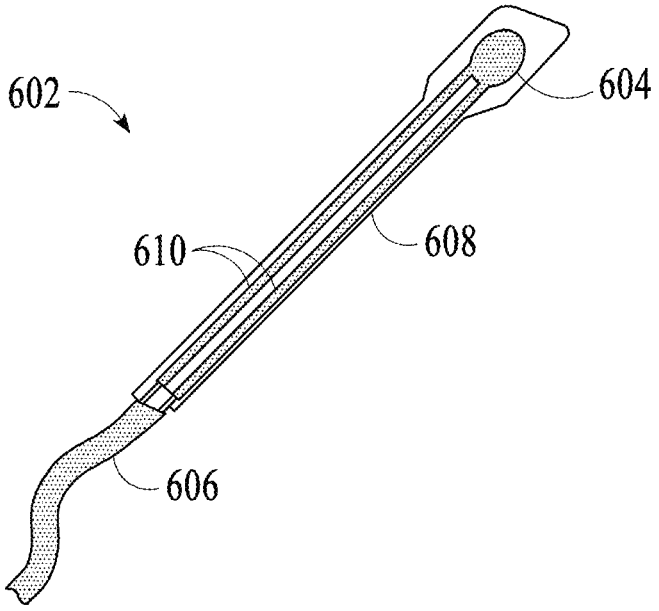
FIG. 6A (PRIOR ART)
FIG. 6A is a diagram depicting an exemplary flexible force sensor in accordance with one exemplary embodiment of the present invention.

In accordance with one exemplary background embodiment of the present invention, this is accomplished through the use of a force sensor, specifically a flexible force sensor for measuring the force between hatch cover casting 230 and lower sealing ring 224 of base flange 220. FIG. 6A is a diagram of an exemplary flexible force sensor in accordance with one background embodiment of the present background invention. Flexible force sensor 602, such as those available from Tekscan, Incorporated of South Boston, Mass., are exceptionally thin, often less than 0.2 mm and generally comprised of a pair of pressure sensitive ink layers, usually circular shaped, with a coextensive conductor layer on either side of the ink, formed on substrate 608. Exemplary flexible force sensor 602 is depicted with a circular sensor area 604, which is the most common shape, and least expensive. However, other shaped sensor areas are readily available, such as square, rectangular, ring-shaped, etc., and vendors offer custom shape and configuration options.

A conductor leg 610 from each of a pair of conductor legs terminates at conductor 606. In practice, each coextensive conductor layer and conductor leg 610 are formed from a single sheet of conductor and separated from each other with an adhesive insulator, but connected to either side of the pressure sensitive ink with an adhesive dielectric. The entire device is packaged in or on a flexible substrate 608 except for the terminal ends for connecting to conductor 606 (typically a pair of conductors or wires). It should be stressed that this sensor embodiment is merely exemplary and other suitable sensors exist, such as wire mesh sensors, force sensitive resistors, semiconductor strain gauges, piezoceramic sensors and others. It should also be mentioned that these types of sensors offer a quantified measurement rather than a qualified measurement, hence, in most cases individual flexible force sensor 602 will need on-site calibrating.

Figure 6B:
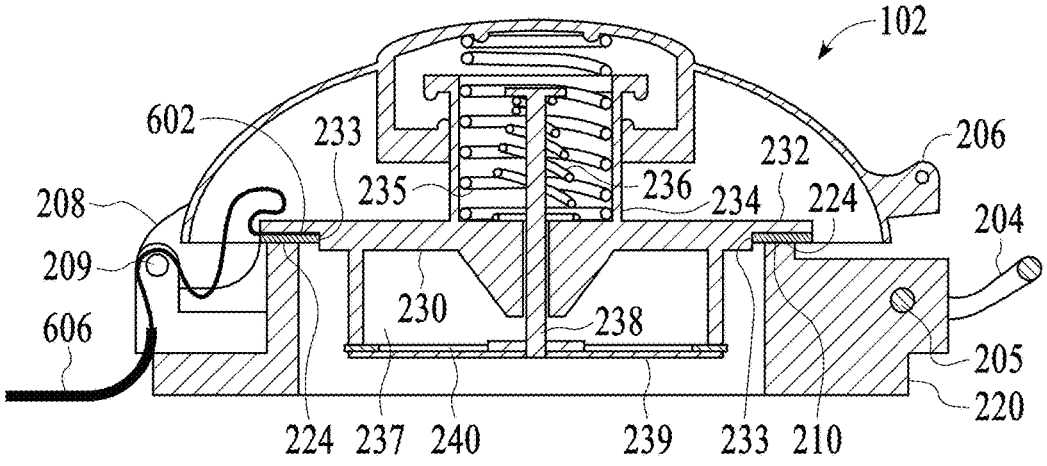
FIG. 6B (PRIOR ART)
FIGS. 6B-6E are diagrams depicting a thief hatch in various closure states with an exemplary flexible force sensor in accordance with one exemplary embodiment of the present invention.
Figure 6C:
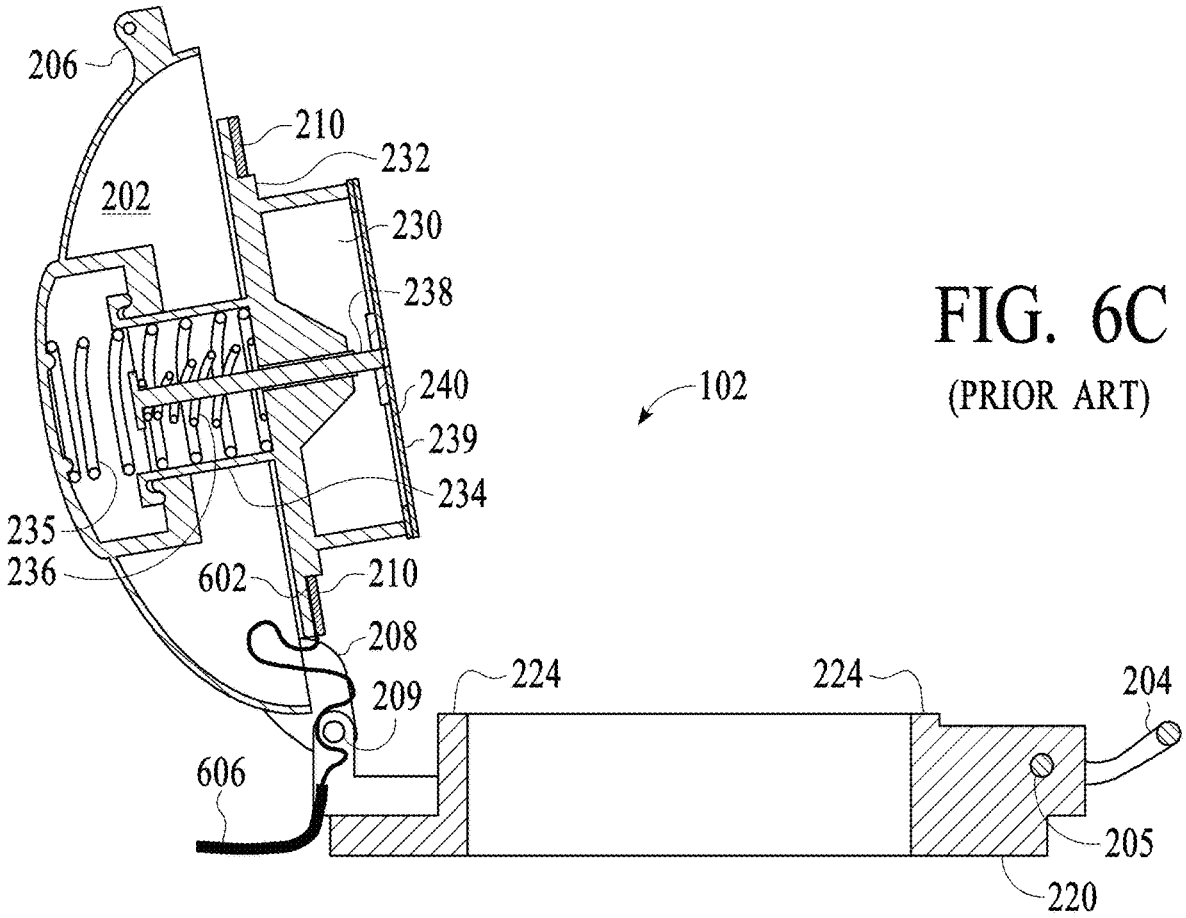
FIG. 6C (PRIOR ART)
Figure 6D:
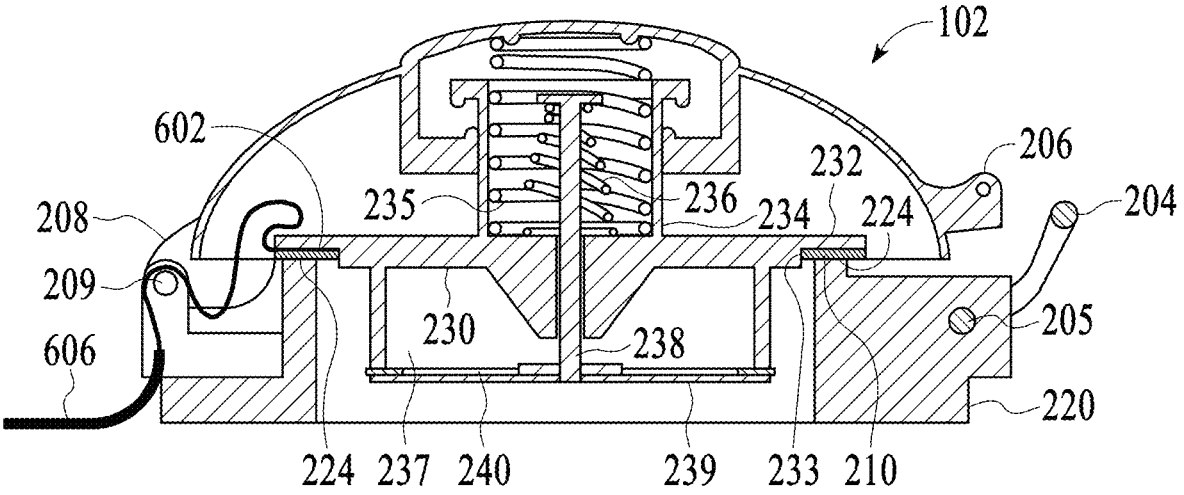
FIG. 6D (PRIOR ART)

In any case, the aim is to position sensor area 604 of flexible force sensor 602 directly between upper sealing ring 232 of hatch cover casting 230 and lower sealing ring 224 of the base flange 220, in direct alignment with pressure gasket 210 as can be appreciated from the diagrams in FIG. 6B as well as from FIG. 6C and FIG. 6D. In so doing, the force exerted across pressure gasket 210 can be accurately sensed as can be readily understood from the pressure diagram depicted in FIG. 7A (discussed further below). More particularly, flexible force sensor 602 is disposed proximate to hatch cover 230 and optimally, mounted near the hinge 208 side of hatch lid 202. In so doing, it is far less likely that flexible force sensor 602 will be damaged by operations using the thief hatch as it will be mounted directly opposite of the working area of the thief hatch.

Figure 9A:
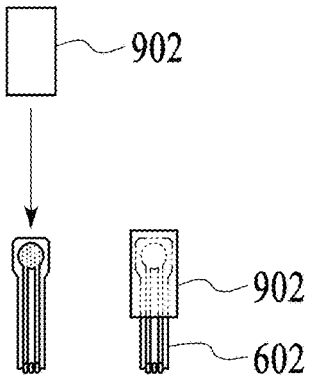
FIG. 9A (PRIOR ART)
FIGS. 9A-9B are diagrams depicting a flexible force sensor configured with a sealing jacket and options of containment within a pressure gasket in accordance with various exemplary embodiments of the present invention.

Flexible force sensor 602 can be mounted on lid 202 using any one of several techniques, each designed to protect the sensor from damage and premature wear. In accordance with one technique, flexible force sensor 602 is mounted directly above pressure gasket 210 and between pressure gasket 210 and upper sealing ring 232 of hatch cover casting 230. Substrate 608 and flexible legs 610 can be pushed up and above lid 202 thereby allowing conductor 606 to be fed over hinge pin 209 and further protected from accidental damage. This technique may result is a very slight leak between substrate 608 and lid 202 if substrate 608 creates a path across lid gasket 210. Therefore, flexible force sensor 602, at least to sensor area 604, may be covered by sealing jacket 902 as depicted in FIG. 9A. Sealing jacket 902 is comprised of a thin layer of gasket material identical to that described above with regard to pressure gasket 210. Optionally, flexible force sensor 602 may be manufactured with sealing jacket 902 or sealing jacket 902 may be manufactured independently for receiving flexible force sensor 602 immediately prior to being installed on a hatch cover. Alternatively, pressure gasket 210 may be manufactured with one or more slits extending from the outer edge for receiving flexible force sensor 602 (not shown). The slit(s) should be wide enough to easily accommodate flexible force sensor 602. Optimally, the slit should not extend through pressure gasket 210 to the inner edge, thereby eliminating any opportunity of pressure to communicate gaseous flow between the inner and outer edges of pressure gasket 210 through the slit.

In accordance with still another exemplary background embodiment of the present invention, gasket material may be extruded around the sensor area(s) of one or more flexible force sensors 602-1 to **602-*n*, thereby enclosing flexible force sensors 602-1 to 602-*n* within pressure gasket 210. This embodiment is graphically depicted in FIG. 9**B.

In accordance with one exemplary background embodiment of the present invention, pressure gasket 210 is formed around a single flexible force sensor 602-1, or alternatively, around a primary sensor and a backup sensor in case of sensor failure (flexible force sensors 602-1 and 602-2). In accordance with other exemplary background embodiments of the present invention, pressure gasket 210 is formed around multiple flexible force sensors that are fixed at predetermined positions about pressure gasket 210, for example four sensors spaced at ninety degree intervals, flexible force sensors 602-1, 602-3, 602-4 and 602-5 or three sensors spaced at one-hundred and twenty degree intervals, flexible force sensors 602-1, 602-6 and 602-7. The benefit of using multiple sensors will be discussed further below with regard to FIG. 7E.

Figure 7A:
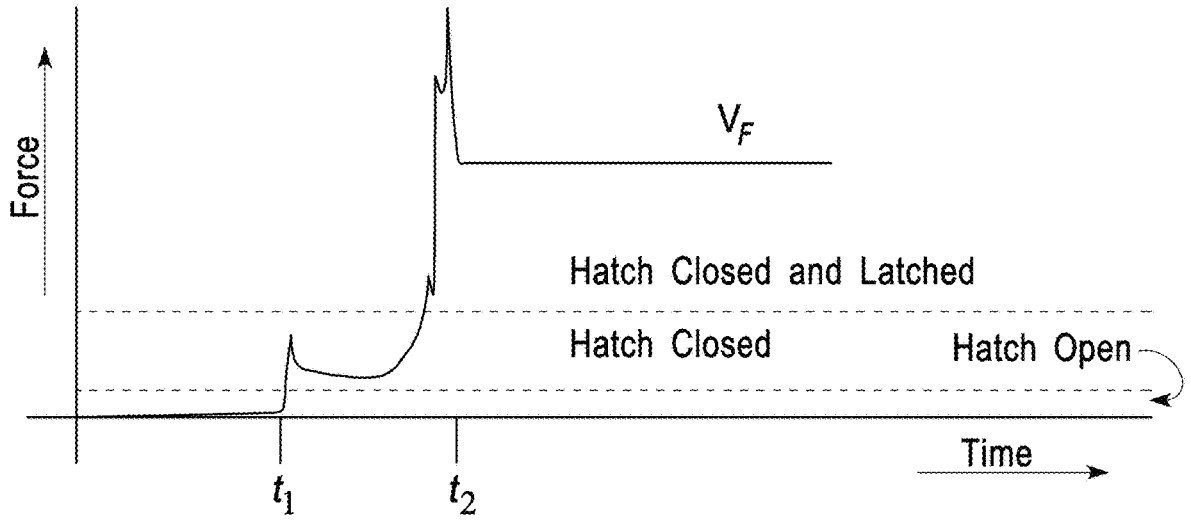
FIG. 7A (PRIOR ART)
FIG. 7A is a diagram of a force chart depicting the force exerted between the upper and lower sealing rings of a thief hatch.

Returning to the discussion of FIGS. 6A-6D, with regard to the pressure chart depicted in FIG. 7A, one advantage of the present background invention is that the placement of flexible force sensor 602 enables operators to readily distinguish between the three closure states of a thief hatch, i.e., open, closed and closed and latched. For example, in FIG. 6C lid 202 is depicted as being in the open state, wherein pressure gasket 210 is not in contact with lower sealing ring 224 of flange base 220, as may be necessary for performing gauging or thiefing operations in a thief hatch. As no force is exerted on flexible force sensor 602, the corresponding force measurement by flexible force sensor 602 reflects the absences of force, as shown in the force diagram in FIG. 7A, prior to time t.sub.1.

Subsequent to the operation, say at time t.sub.1, the hatch is first closed, but not latched as shown in FIG. 6D with lid 202 down and the weight of lid 202 and hatch cover casting 230 generating a force across pressure gasket 210. During this time period, the force sensed by flexible force sensor 602 is greater than the force detected with the hatch open, but, as will be discussed later, much less than the force detected with lid 202 being latched. The force diagram in FIG. 7A depicts the force detected by flexible force sensor 602 with lid 202 closed but not latched between times t.sub.1 and t.sub.2.

Figure 6E:
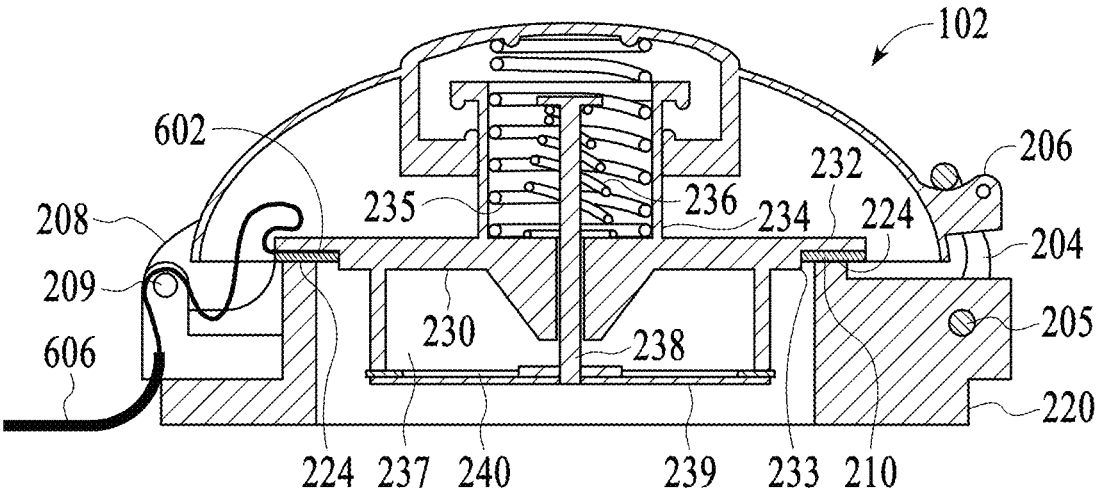
FIG. 6E (PRIOR ART)

Finally, the act of latching most contemporary thief hatches, depicted graphically in FIG. 6E, creates a latching force across pressure gasket 210 that is greater than the force generated by the hatch being merely closed. As discussed above with regard to FIGS. 2 and 3, the sealing force of thief hatch 102 is actually created by pressure compensation spring 235 exerting force between lid 202 and hatch cover casting 230. As lid 202 is closed, pressure compensation spring 235 is compressed and forces hatch cover casting 230 toward base flange 220. In so doing, the entire circumference of upper sealing ring 232 of hatch cover casting 230 is forced down on to the entire circumference of lower sealing ring 224 of flange base 220, across pressure gasket 210. The latching force reduces the possibility of leakage by deforming the shape of pressure gasket 210 to the surfaces of upper sealing ring 232 on hatch cover casting 230 and lower sealing ring 224 of flange base 220. The difference between the closing force exerted on flexible force sensor 602 and the latching force can be seen clearly on the force diagram depicted in FIG. 7A, subsequent to time t.sub.2.

Figure 7B:
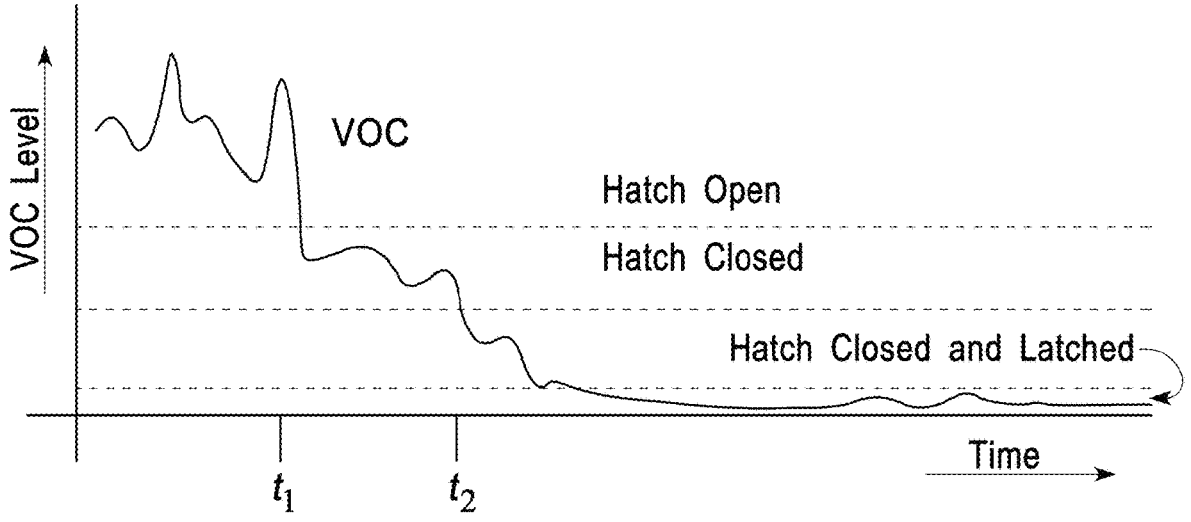
FIG. 7B (PRIOR ART)
FIG. 7B is a diagram of a VOC emissions chart depicting the VOC levels escaping a thief hatch in various closure states.

The importance of verifying that a thief hatch is securely closed and latched cannot be overstated. With regard to VOCs escaping into the atmosphere, a closed but not latched hatch cover is more similar to an open hatch cover than to a latched hatch cover. Current hatch covers and hatch lids are usually fabricated from lightweight materials such as aluminum, and designed to minimize the amount of material needed. Hence, these hatch covers and hatch lids are extremely light and, therefore, will not provide a sufficient seal to completely block escaping VOCs. FIG. 7B is a diagram of VOC emission corresponding to the time periods of FIG. 7A. Notice that, as expected, the level of escaping VOCs is very high while hatch cover 202 is open, prior to time t.sub.1, and extremely low when hatch cover 202 is closed and latched subsequent to time t.sub.2. However, in the time between time t.sub.1 and time t.sub.2, the level of escaping VOC remains rather high, very close to the VOC emission level with the hatch open. Therefore, forgetting to or improperly latching a thief hatch may have the same detrimental consequences as leaving the hatch open.

Another advantage of the presently described invention that may not be readily apparent is the ability to monitor the condition of the sealing force and accurately predict gasket and other failures that result in the escape of VOCs. By using a data logger (as will be described later with regard to FIGS. 8A and 8B), the force generated by latching may be recorded and monitored for changes indicating a potential failure that would result in VOCs escaping.

Figure 7C:
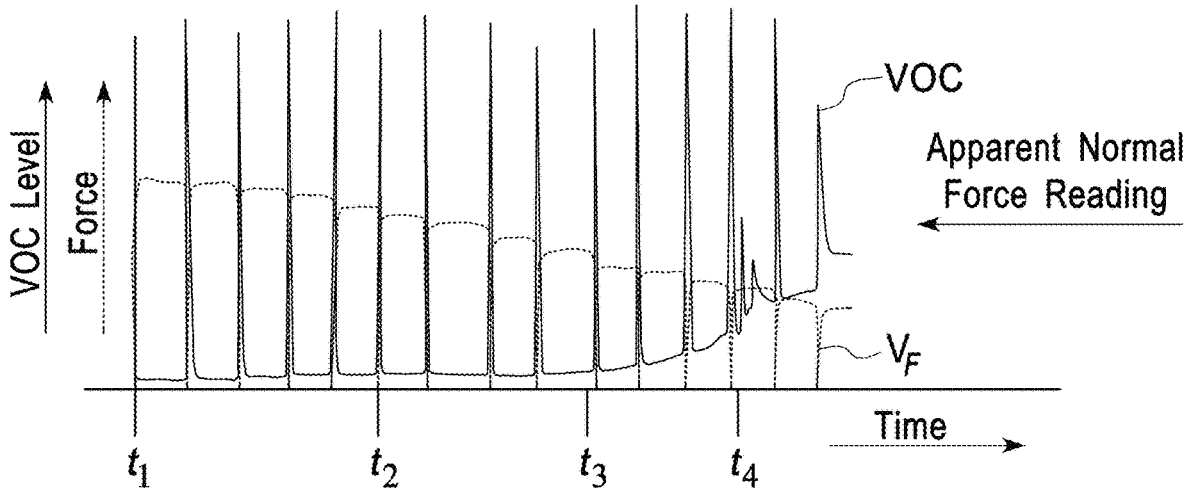
FIG. 7C (PRIOR ART)
FIGS. 7C and 7D are diagrams of a combination force and VOC emissions chart depicting the force exerted between the upper and lower sealing rings of a thief hatch and the corresponding levels of VOC escaping a thief hatch in various closure states over a time period.

There are two cases in particular. The first depicted on the VOC/force chart depicted in FIG. 7C relates to a decrease in latching force. During a time period, say between time t.sub.1 and time t.sub.2, where pressure gasket 210 is new, the latch force (V.sub.F correlating to the voltage generated by the flexible force sensor) remains fairly constant at an apparent normal force reading wherein the hatch is repeatedly open for gauging/thiefing operations (shown as a low voltage spike on V.sub.F and a corresponding high VOC level spike on VOC in FIG. 7C). However, at some point the gasket begins to lose its flexibility, crack, tear or otherwise deteriorate. This degradation results in the latching force decreasing as realized from the flexible force sensor opening between times t.sub.2 and t.sub.3. Between times t.sub.3 and t.sub.4 escaping VOCs can be noticed from the increasing VOC level. At some point, time t.sub.4 in FIG. 7C, the pressure gasket fails and the VOC level increases substantially. Here, the advantage of using the present invention is that patterns of gasket degradation can be recognized and tracked from the data log created for latching force, and when the force drops below a threshold level, the pressure gasket may be replaced or other maintenance performed as necessary.

Figure 7D:
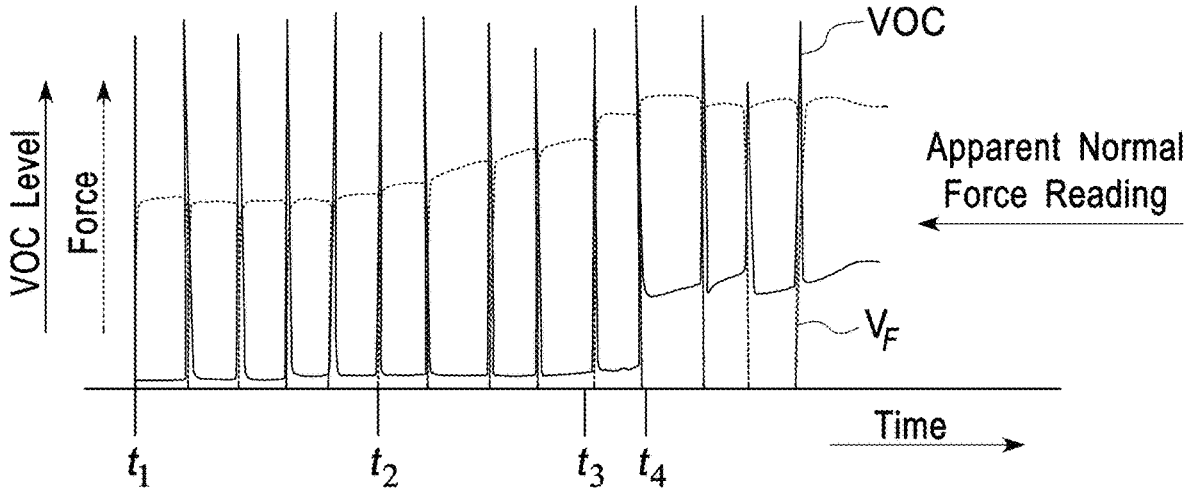
FIG. 7D (PRIOR ART)
Figure 7E:
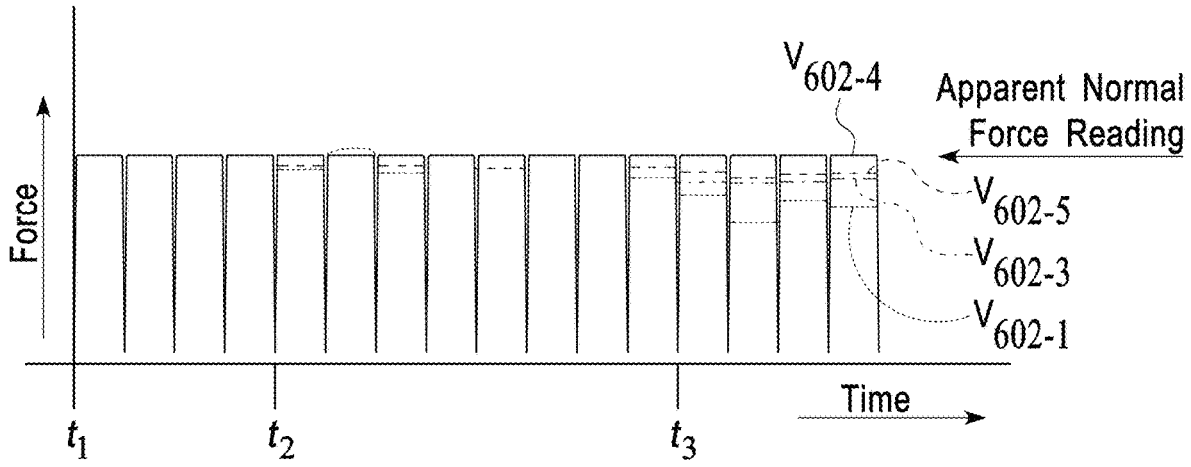
FIG. 7E (PRIOR ART)
FIG. 7E is a diagram of a force chart depicting the forces exerted between the upper and lower sealing rings of a thief hatch at various positions and at various closure states over a time period.

The second case relates to an increase in latching force as depicted on the VOC/force chart depicted in FIG. 7D. Here, during a time period between time t.sub.1 and time t.sub.2, where pressure gasket 210 is new and the sealing surfaces are clean and free of contaminants, the latch force remains fairly constant at an apparent normal force reading just as in FIG. 7C above. However, over time, between times t.sub.2 and t.sub.3, dirt, debris, dried oil and other contaminants build up as a film of contaminants on each of the adjacent surfaces of pressure gasket 210 and lower sealing ring 224 of base flange 220 (from spillage and mess from repeated gauging and thiefing operations). This decreases the gap between pressure gasket 210 and lower sealing ring 224 and resulting in a slightly higher force when the cover is latched. This film of contaminants does not provide the same sealing properties as clean surfaces and will eventually leak, time t.sub.4 in FIG. 7D. Here again, the key to using the force data log is to recognize patterns developing and take appropriate action prior to a serious VOC leak event.

Figure 9B:
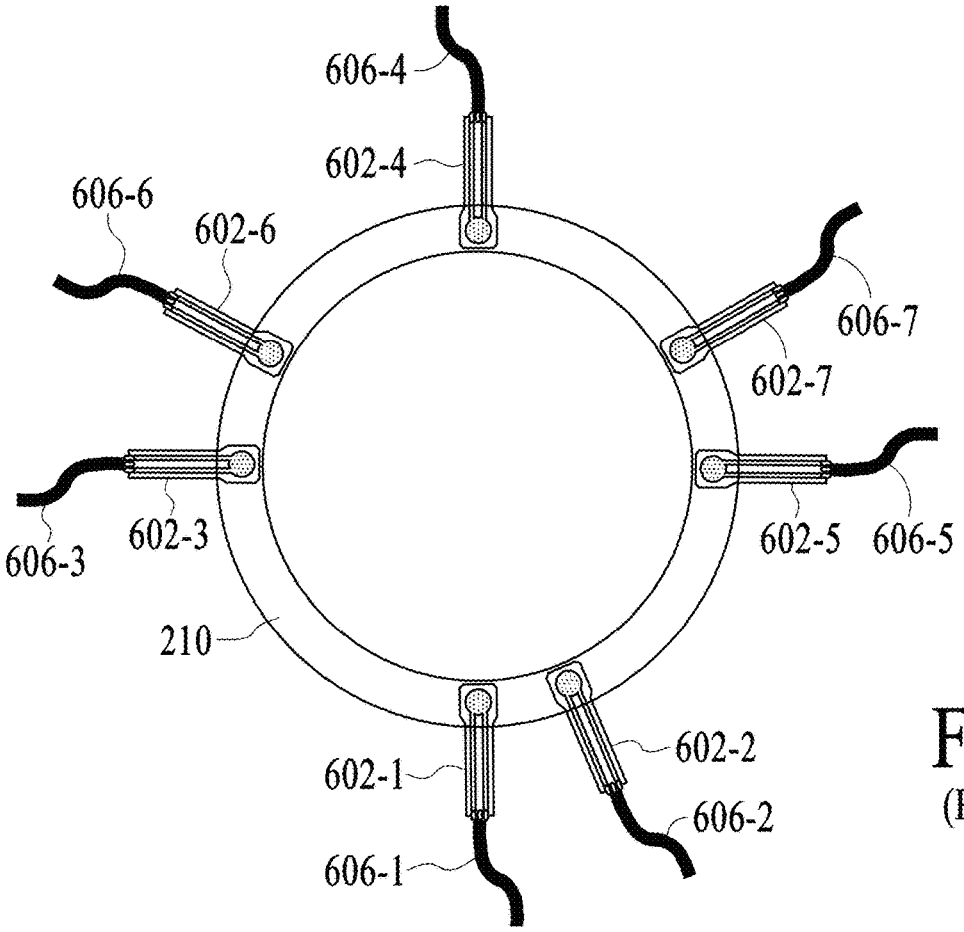
FIG. 9B (PRIOR ART)

Of course, sensor reliability is critical, therefore, having a backup flexible sensor in place is advantageous, such as flexible sensors 602-1 and 602-2 as depicted FIG. 9B. In so doing, any of the readings in FIGS. 7A-7C would be essentially duplicated by a pair of force readings. If the pair of readings ever diverged, that would indicated a sensor failure or at least a problem needing investigation.

In addition, recalling the discussion of the closure forces that act on pressure/vacuum valve 234, there may be circumstances where the force exerted around the circumference of pressure gasket 210 may not be constant. And/or, one area of pressure gasket 210 may be more prone to failure than another area. Hence, placing multiple sensors around the circumference of pressure gasket 210 may increase the likelihood of detecting the onset of a problem over using a single sensor, such as using four sensors positioned at ninety degree intervals, for example flexible force sensors 602-1, 602-3, 602-4 and 602-5 depicted in FIG. 9B. Turning to the force chart shown in FIG. 7E, notice that at the time period between time t.sub. 1 and t.sub.2, the reading of flexible force sensors 602-1, 602-3, 602-4 and 602-5, i.e., V.sub.602-1, V.sub.602-3, V.sub.602-4 and V.sub.602-5, all track on a normal force level. However, some divergence between the readings from the apparent normal level is noticeable between times t.sub.2 and t.sub.3, especially with regard to flexible force sensor 602-1, reading V.sub.602-1 and the other sensors. Subsequent to time t.sub.3, the divergence of flexible force sensor 602-1, reading V.sub.602-1 from the apparent normal force level is readily noticeable (as is some divergence between flexible force sensors 602-3 and 602-5, readings V602.*sub*.-3 and V.sub.602-5 from the apparent normal force level). Clearly, the multiple force readings depicted on the diagram in FIG. 7E would indicate that an issue involving pressure gasket 210 has developed after time t.sub.3.

In accordance with various exemplary background embodiments of the present invention, the system for monitoring the state of hatch cover closure comprises several components: the force sensor, a monitor/detector for monitoring or detecting a reading from the force sensor, a power supply and an optional cry-out alarm (not shown). The monitor may be as uncomplicated as a normally-open circuit (such as a switching transistor) that closes and completes an electrical circuit in response the force sensor's reading dropping below an alarm threshold level (also not shown). In response, the cry-out alarm is activated. In a very uncomplicated exemplary embodiment (not shown in the figures), a power supply (battery) is electrically coupled to a switching transistor (normally open switch) through a force sensor, a cry-out alarm (visual or audio) and through the switching transistor. All the components except the sensors itself may be enclosed in a safety case and mounted on the thief hatch, if the cry-out alarm is visual, mounted in open sight. The force sensor is then mounted between the upper and lower sealing rings.

Figure 8A:
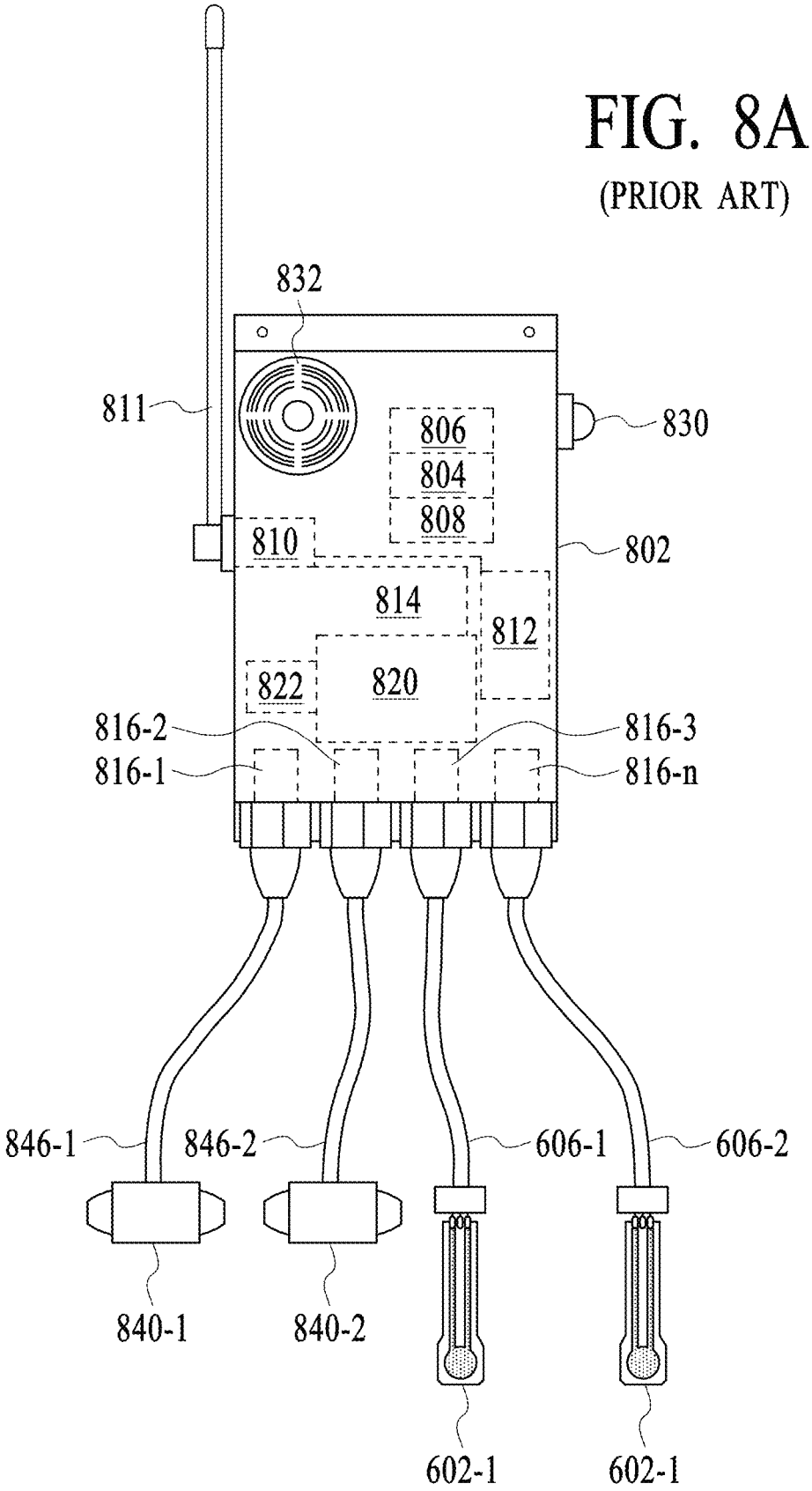
FIG. 8A (PRIOR ART)
FIGS. 8A-8B are diagrams depicting a monitor unit, sensors and thief hatch in various configurations in accordance with one exemplary embodiment of the present invention.
Figure 8B:
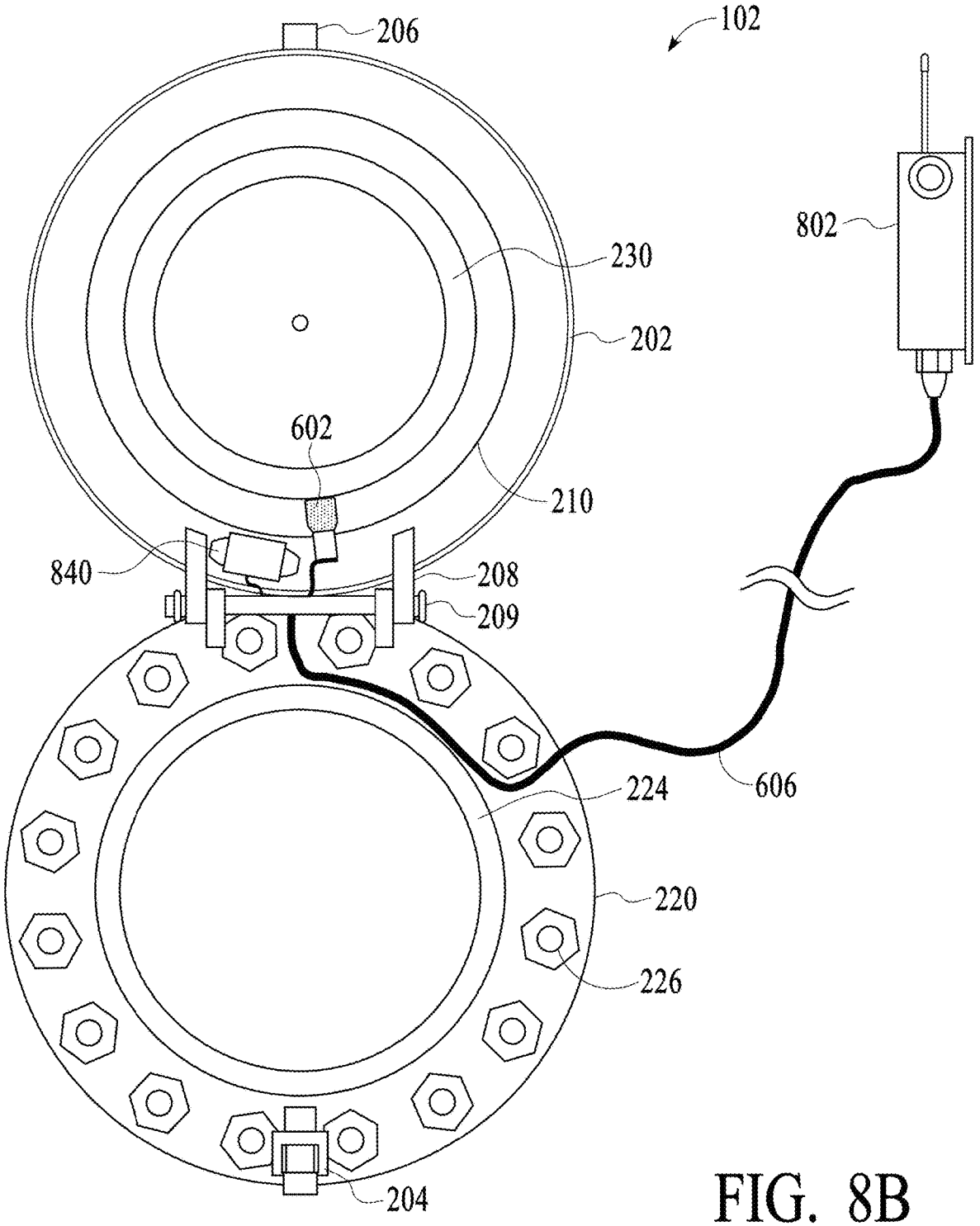
FIG. 8B (PRIOR ART)

In practice, a more sophisticated approach is usually warranted, which is generally depicted in FIG. 8B. Force sensor 602 is electrically coupled to a monitoring unit for reading and processing voltages into force measurements. One monitoring unit is the Advantis Monitoring System (AMS) (available from Advantis, L.L.C. in Marshall, Texas). Monitoring unit 802 depicted in FIG. 8A is one exemplary embodiment of the present invention. At a very low level, monitoring unit 802 comprises at least one sensor port/interface 816-1 thru 816-*n* for supplying power to sensors, such as force sensor 602 and for receiving measurement signal data from the sensor and a communications unit for communicating the data to a remote location such as a data or processing center. Sensor port/interface 816-1 thru 816-*n* may be coupled to multiple sensors on a single thief hatch, single sensors on multiple thief hatches, or some combination of the two. Optimally, sensor port/interface 816-1 is coupled to communications unit 810 via data bus 814. Communications unit 810 may support any or all of satellite, cellular, radio, microwave, laser and other wireless communications using an appropriate antenna 811. Additionally, communications unit 810 may also support landline PSTN, Ethernet, fiber-optic, coaxial and other wired communication means at communication port 812. Monitoring unit 802 may receive power from battery 820, which may be internal or external, (solar panels and wind turbines are optional) and/or AC power via power adapter 822. Optionally, monitoring unit 802 may also provide basic or very sophisticated local processing using processor 806, ROM/RAM 804 and I/O 808. Monitoring unit 802 may further comprise one or more local priority cry-out alarms such as warning light 830 and audible alarm 832.

Furthermore, although the previous discussion of force sensors focuses on analog type devices, other sensors are readily available, such as digital sensors. Hence, monitoring unit 802 may receive either analog or digital measurement signal data from the sensors. That signal data may be a raw digital or raw analog signal and transmitted directly as raw signal data. Alternatively, the raw data may be processed by a routine executing on by processor 806 or into another form or protocol depending on the measurement/alarm routine being executed on processor 806, which was stored in ROM/RAM 804. I/O 808 generally converts the signal data from one form or other depending on the component receiving the data from I/O 808.

Basically, monitoring unit 802 delivers power to sensors and receives voltage or other sensor signals and in response communicates that data to data/processing remote centers, clouds, or portable devices. Ideally, information gathered from monitoring unit 802, whether remote, local, or mobile sources, makes its way to a web application in the cloud, such as the Advantis Web Application also available from Advantis, L.L.C., which can be viewed by computer and smart phone. These devices may then process the data locally and/or compare the data to alarm thresholds and the like.

In accordance with other exemplary background embodiments of the present invention, monitoring unit 802 may support a variety of different priority cry-out alarms. The purpose of a cry-out alarm is to alert someone that an alarm threshold has been crossed and a warning condition exists. Whenever a warning condition is detected (such as a thief hatch being/remaining unlatched), monitoring unit 802 activates a cry-out alarm, for example local alarms as discussed above. Also, monitoring unit 802 may utilize electronic (digital) cry-out means in the event of a warning condition, such as sending email message, text message, pager message, voice message, web app message, mobile app message, dashboard message or other type of electronic messages to designated recipients at a predetermined electronic addresses. Additionally, monitoring unit 802 may implement a priority of cry-out messages that escalates to higher level electronic addresses as the warning persists without resolution. In either case, monitoring unit 802 typically determines whether an alarm threshold has been exceeded, rather than the threshold determination being made at a remote site.

As discussed above, monitoring unit 802 may support multiple sensors, from separate hatches, multiple sensors at a single hatch or some combination of the two. One advantage of the presently described monitoring system is its ability to support a plurality of different sensor types simultaneously, for example, force sensor 602 and VOC detector 840-1 thru 840-*n*. Additionally, monitoring unit 802 may also support digital and/or analog sensors, and may also implement complicated risk management routines to determine the closure and/or physical/maintenance states of a thief hatch for transmission to a network, processing and/or data warehousing sites, a cloud and/or predetermined remote locations.

In accordance with an exemplary embodiment, monitoring unit 802 may be situated at a central location at a site for supporting several thief hatch sensors. Depending on the extent of the facility, multiple monitoring units 802 may be installed. In this configuration, the sensors are mounted to the thief hatches and sensor conductors run from the hatches to the monitoring units. If visual and/or audio cry-out alarms are present, they should be positioned such that the alarm is easily visible (and/or audible). For small facilities (or applications involving only a single hatch), monitoring unit 802 may be located near a thief hatch, proximate to the force sensor. There, the cry-out alarm should be positioned such that operators working at the hatch can easily detect any alarm.

As depicted in FIG. 8B, monitoring unit 802 may be electrically coupled to both force sensor 602 and VOC detector 840 via conductors 606 and 846 respectively (in FIG. 8B conductor 846 being shown as part of conductor 606 input to monitoring unit 802, such as by way of simple wire harness-type arrangement). Typically, VOC sensor 840 is mounted on lower side of lid 202 and above pressure gasket 210 and lower sealing ring 224. Note that FIGS. 8A and 8B are shown as prior art for discussion purposes with respect to background embodiments; it should be understood, however, that monitoring units such as 802 may receive as inputs data from pressure or other force sensors as described herein in connection with certain preferred embodiments, and such illustrations are not prior art when used with preferred embodiments herein.

Figure 10A:
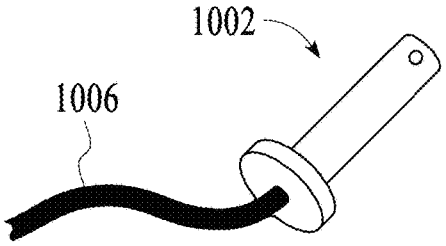
FIG. 10A (PRIOR ART)
FIGS. 10A-10C are diagrams depicting a thief hatch in various closure states with an exemplary pin-type force sensor in accordance with one exemplary embodiment of the present invention.
Figure 10B:
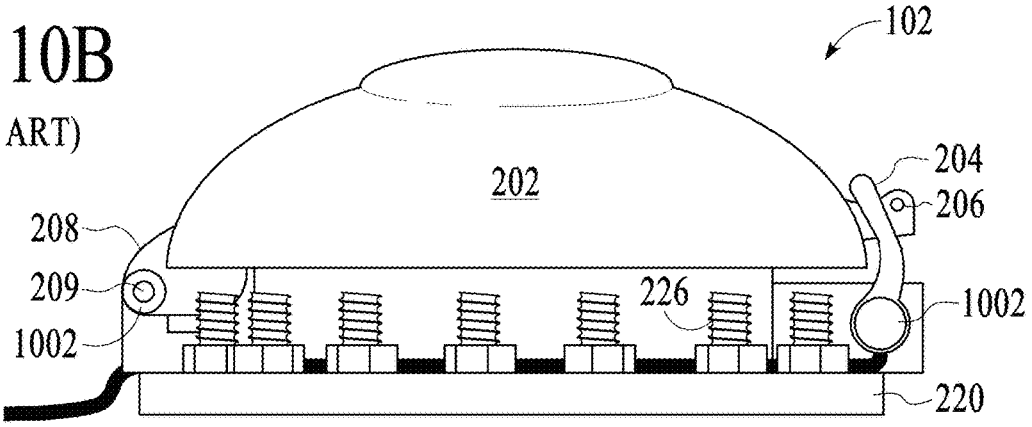
FIG. 10B (PRIOR ART)
Figure 10C:
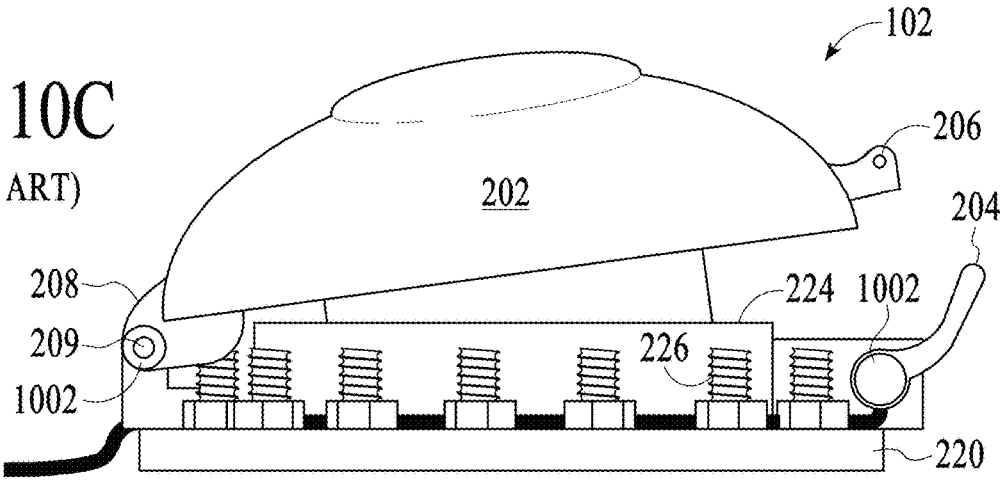
FIG. 10C (PRIOR ART)

In accordance with still another exemplar of the present invention, a force sensor is incorporated in either a latch pin or hinge pin as depicted in FIGS. 10A, 10B and 10C. Here, rather than measuring the force applied to lid 202, directly at pressure gasket 210, the closing force is measured at one or more pins used to secure lid 202 to flange base 220. In the diagrams, force sensor pin 1002 replaces latch pin 205. In so doing, once lid 202 is latched, the force measured by force sensor pin 1002 will increase. Alternatively, force sensor pin 1002 may instead replace hinge pin 209. In this configuration, force sensor pin 1002 will accurately distinguish the force levels generated at the opened, closed, and closed and latched closure states of the thief hatch.

Referring now to FIGS. 11A-12B, exemplary preferred embodiments of the present invention will now be described, which provide for a pressure/vacuum sensor and preferably a calibrated measurement of internal tank pressure, which enables vent conditions to be more precisely determined and monitored, with VOC emissions able to be calculated/estimated, along with other advantages herein described.

Previously described background embodiments utilize a force sensor (e.g., force sensor 602) to sense force on pressure gasket 210. This provided hatch open, hatch closed but not latched, hatch closed and latched, status conditions as previously described. The previously described force sensor does not measure once the landing ring has cleared the contact surface. In order for the force sensor to provide a reading, it must have a force applied to it. It also is known that, through empirical testing typically performed on behalf of the hatch manufacturer, an estimate of when the hatch vents and the associated volume (CFM) can be derived. Hatch manufacturers typically provide a flow chart for pressure and associated volume (CFM) that is vented.

Exemplary preferred embodiments herein described utilize a pressure/vacuum sensor to provide advantages over the background embodiments. Data from the pressure/vacuum sensor in preferred embodiments is used to provide a number of advantageous functions/operations: (1) a determination that a vent condition has begun; (2) a calculation of estimated volume (CFM) of gas vented over a first range of flow levels; (3) using the hatch manufacture's pressure/CFM flow chart to look up the amount of gas vented based on internal tank pressure, provided a calculation of estimated volume of gas vented over a second range of flow levels; and/or (4) numerous alarms based on the foregoing, and also an alarm if the tank moves from positive pressure to vacuum, indicating that outside air is being pulled into the tank). In accordance with such preferred embodiment, a mechanism to calibrate each individual hatch, namely an isolation seal for calibration, is provided so that a determination can be made as to when venting will begin. In accordance with embodiments, calibration may be accomplished while the hatch remains installed on the tank, and not requiring removal and calibration testing.

In accordance with such preferred embodiments, vent events of the first and second range of flow levels may be distinguished. Herein, a vent condition begins when the tank pressure reaches a level such that there is no longer a 100% seal, and thus flow occurs from the vent condition initially in the first range of flow levels. The internal tank pressure may continue to increase and the vent condition may move into the second range of flow levels, which occurs when there is enough internal tank pressure to start reading directly from the manufacturer's pressure/CFM flow chart. The original design of the tank hatch, many years ago, was to prevent explosion and implosion of tanks, and not necessarily to seal them or to detect or prevent or monitor leaks and flows. In conventional systems, detection of vent conditions and measuring the gas flow over a plurality of ranges has not been possible. Based on inventor study, a significant portion of gases released into the environment are a result of vents in the first range of flow levels, not necessarily larger vent events in the second range of flow levels. With increasingly stringent environmental concerns and regulations, it is advantageous to measure and record any gas releases from tanks and calculate/estimate amount of gas vented. There may be taxes or other fees assessed by on the amount of gas released. Preferred embodiments of the present invention provide improved, cost effective and practical implements and methods to record vent events and provide measured or estimated total gas releases.

The hatches are in effective very large pressure relief valves. There are different spring compression rates (measured in ounces of pressure) to allow the operator or manufacturer/installer to tune the vent pressure to the requirements of the tank's design. The compressed spring is designed/selected to provide the necessary force to seal. The internal tank pressure overcomes the spring and thus vents the pressure to atmosphere. The hatch manufacturer typically provides a pressure/CFM flow chart based on the compression rate of the spring in the hatch.

The inventor has discovered a significant benefit to having both a force sensor on the gasket, or an alternative force sensor as described hereinafter, and a pressure sensor for internal tank pressure. The use of a pressure sensor for internal tank pressure and a force sensor corresponding to force on gasket, coupled with being able to calibrate the hatch in place on the tank to know the internal pressure at which the hatch begins vent, are advantageously utilized in preferred embodiments, as inputs to estimate/calculate vented CFM in the first range of flow levels and to also look up venting CFM from the manufacturer's flow chart when the internal tank pressure reaches a certain level (i.e., in the second range of flow levels). In accordance with such embodiments, a more complete picture of gas releases as well as the volume of gas released may be calculated or estimated, with appropriate data reports generated such as for operational or regulatory compliance purposes. A plurality of alarms also may be advantageously provided.

The hatch on top of the tank, when venting, with sensors as provided herein can be viewed as a flowmeter and thus in general flow calculations may be made. For example, consider the formula available at: Georgiev G.Z., "Flow Rate Calculator", https://www.gigacalculator.com/calculators/pipe-flow-rate-calculator.php. Pressure P1 (pressure sensor) and P2 (ambient pressure) are determined. The open area the gas is flowing through (force sensor as a percent of seal) is estimated/determined based on readings from the force sensors. With these pressure values and an opening modeled based on the particular hatch and force sensor readings, with such a formula, flow rates may be estimated/calculated real time and recorded. The present invention is not limited to any particular calculation method. What is important is that, using P1, P2 and an estimate of opening/orifice size, flow rates are estimated/calculated by formula, modeling, curve fitting or the like.

In preferred embodiments, the vent condition is detected and flow rates are determined based on the formula in the first range of flow levels until the hatch either returns to a condition of seal, or pressure inside the tank continues to build and the vent condition becomes a second range of flow level vent condition. In accordance with preferred embodiments, once the internal tank pressure reaches the minimum pressure on the manufacturer's pressure-CFM flow chart, it is considered a vent condition in the second range of flow levels and the flow rate may be obtained as a look up from the manufacturer's pressure-CFM flow chart (note that such pressure-CFM flow chart may be produced by the manufacturer or some other entity or person, and the present invention is not limited as to the source or type of chart, as will be appreciated by those of skill in the art). In an exemplary preferred embodiment, the percent of seal goes from full seal (100%) at the point where the beginning of vent condition is detected, to no seal (0%) at the point at which tank pressure reaches the level at which the pressure-CFM flow chart may be utilized. The pressure-CFM flow chart in effect provides an orifice size estimate, which is reflected in the flow rates in the chart (based on the pressure difference/orifice size calculation referenced previously). Thus, percent of seal may correlate inversely (such as on a linear or other modeled or calibrated basis) to effective size of orifice such that flow rates may be estimated/calculated in the first range of flow levels. Such arrangement being exemplary, as other means of estimated orifice size and/or flow rates based on tank pressure and/or force sensor readings are utilized in alternative preferred embodiments.

What should be appreciated from these exemplary preferred embodiments, is the ability (and significance of doing so) to measure the flow rate of vent conditions before the tank pressure gets to the beginning pressure of the manufacturer's flow rate chart or similar look-up data. The inventor has determined that many if not most hatches are in this lower range level of vent conditions a significant amount of the time as compared to the larger range of vent conditions. In accordance with preferred embodiments, the force sensor senses small changes on the seal of the gasket to determine beginning of the vent condition and estimate percentage of seal/opening size, giving the ability with the pressure senor to estimate/calculate small flow levels.

An additional element necessary to calculate both first and second range of flow level vent conditions is knowing the initial vent condition beginning point. In general, each hatch is a unique, dynamic system. Some of the variables at play are tank pressure, gasket condition, including wet or dry gasket, hatch machined surfaces, and force on gasket, as illustrative examples. In a perfect world, one would take each hatch off the tank (difficult and time consuming at best), install it on a test fixture, and pressure test it to determine the vent condition start point. Clearly, removing the hatch to a test environment is not practical.

In accordance with exemplary preferred embodiments, an isolation seal is provided such that a calibration procedure may be used to measure pressure and flow rates to determine the beginning of the vent condition start point. The isolation seal physically isolates the hatch opening from the tank, in effect creating a false bottom or floor. The isolation seal creates a small and controlled air space below the hatch opening, with little space between the gasket seal of the hatch lid and the false bottom of the isolation seal. With the isolation seal in place, compressed air is externally provided to slowly pressure up the space and determine the vent condition start point. This vent condition start point preferably is determined with a flow meter on the input external air. As an example, pressure may be stepped up and flows monitored. When the pressure reaches a point that the vent condition begins, steady flow in general will be detected. Pressure values are recorded during the process, and preferably force sensor values as well, such that the hatch is calibrated to know when vent conditions will begin based at least in part on tank pressure. It should be noted that where hatches typically are installed are often considered a Class I Div 2 explosive area, and as such any electronics used must be properly UL (Underwriters Laboratory) rated. In accordance with exemplary preferred embodiments, calibration may be conducted generally with compressed air, a pressure gauge, and a flow meter, providing safety advantages with most tanks. Monitoring electronics, such as described herein (e.g., FIG. 8A), preferably are utilized to record the values from the gauge and sensors, which are implemented using properly rated electronics.

The isolation seal for calibration generally consists of a base and a seal. The base preferably is about ½" thick to fit into the small space between the hatch opening and the tank, and in general must bridge an 8" diameter opening for a typical hatch configuration, and must be able to withstand pressure from compressed air without giving away and falling into the tank. The isolation seal preferably includes a foam gasket material preferably with a neoprene base that expands against the side walls of the hatch flange to create the seal. In alternative embodiments, the isolation seal is created with an inflatable bladder-type construction, such that with compressed air the bladder expands and seals against the side walls of the flange. The isolation seal in preferred embodiments expands and holds downward pressure in an area that typically is around 8 inches or larger and can only be accessed through the tank hatch opening.

Figure 12A:
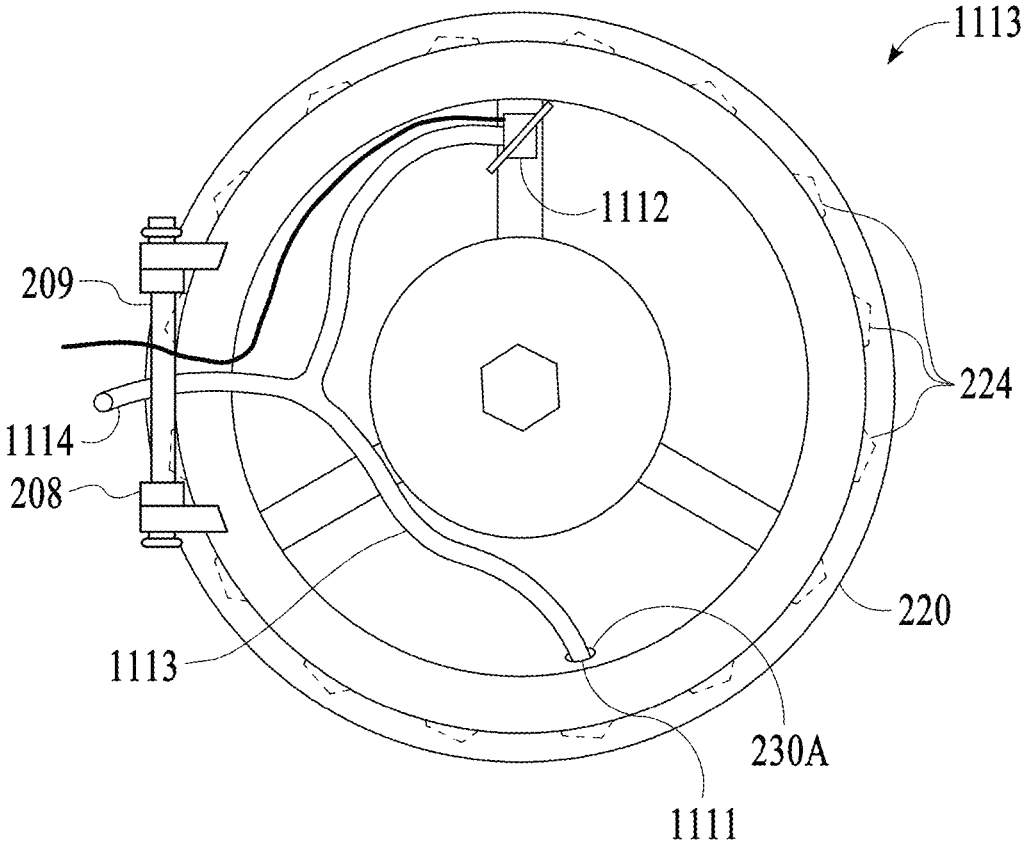
FIGS. 12A and 12B are diagrams depicting a preferred embodiment in which internal tank pressure is measured.
Figure 12B:
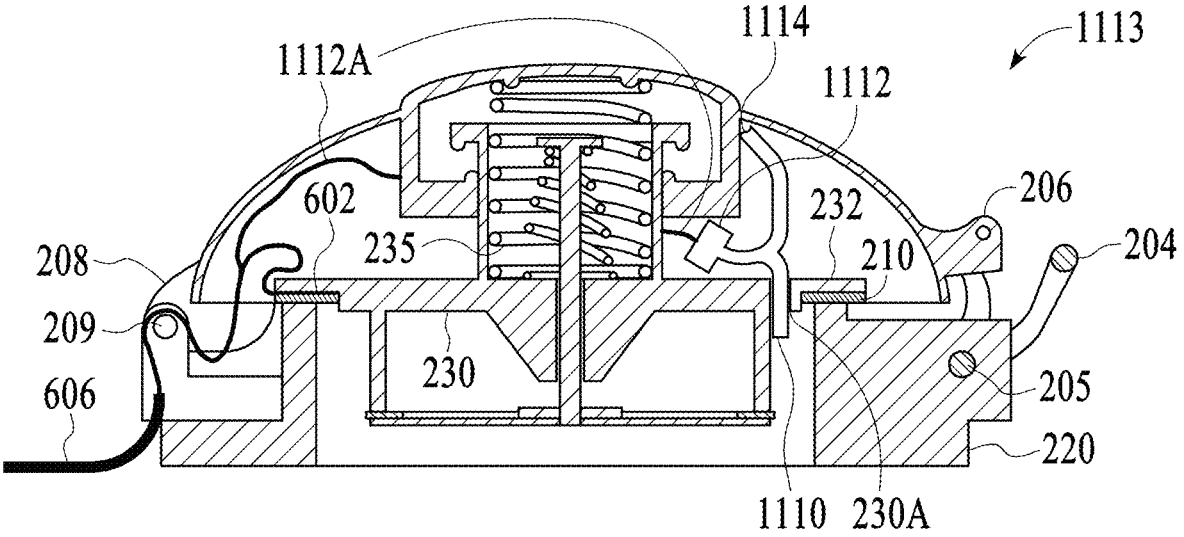

Referring now to FIGS. 12A-12B, exemplary preferred embodiments utilizing an isolation seal and internal tank pressure/vacuum sensor will now be described. In preferred embodiments, hole 230A is formed such as by drilling in hatch cover 230. This allows tank pressure leg (tube) 1110 to extend through hatch cover 230 so that the opening in tank pressure leg 1110 is presented with tank internal pressure so that pressure/vacuum sensor 1112 detects/senses internal tank pressure. Hole 230A, depending on the type of hatch, can be drilled or formed in any manner (including at the time of manufacture) and angle to achieve the tank pressure sensing purpose without interfering with the mechanical operation of the hatch. What is important is that internal tank pressure is presented to a tube or other element so that internal tank pressure may be sensed by pressure/vacuum sensor 1112. It also should be noted that tank pressure leg 1110 preferably also serves as an inlet for compressed air during calibration, as described herein. It also should be noted that the hole or penetration through hatch cover 230 must be sealed mechanically or with sealing compound for the finished port to be sealed around tank pressure leg 1110. In alternative embodiments, a tube is not used, but instead a fitting on top of a port formed in hatch cover 230 is utilized, and tank pressure leg 1110 is attached to the fitting so that tank pressure is presented to pressure/vacuum sensor 1112.

In preferred embodiments, tubing is used to connect the drilled port (via hole 230A) to pressure/vacuum sensor 1112. Between the port and sensor 1112, a 'Y' tube configuration preferably is implemented, such that one leg of the 'Y' goes to pressure/vacuum sensor 1112, while the other leg 1114 may be connected to an external air source so that external compressed air may be applied during calibration with the isolation seal in place. Leg 1114 needs to be long enough to allow connection of external compressed air when hatch 102 is latched. When the isolation seal is not in place and being used for calibration, leg 1114 is plugged and moved out of the way of operation. Leg 1114 may be sealed, for example, with a threaded cap and fitting suitable for this type of air line.

Pressure leg 1110 is coupled to pressure/vacuum sensor 1112 and preferably is positioned in the area above the vacuum seal of hatch cover 230 and underneath lid 202 so as to not interfere with plunger-type operation of hatch 102. In preferred embodiments, legs 1110 and 1114 and pressure/vacuum sensor 1112 are anchored with conventional connecting implements such as tie wraps. FIG. 12A illustrates an exemplary positioning of legs 1110 and 1114 and pressure/vacuum sensor 1112. It should be noted that pressure/vacuum sensor 1112 may be an absolute, gauge, or differential type sensor.

It should be noted that in alternative preferred embodiments sensor 1112 and leg 1114 are located outside of the thief hatch assembly with only tube 1110 routed into the thief hatch assembly (the position of sensor 1112 in the figures being exemplary). As will be appreciated, in certain environments moving metallic (e.g., wire) components and electronics from inside the thief hatch may be preferable, such as in an H2S environment. Such an arrangement also may make field installation easier in certain situations. What is important is that the pressure sensor and tubular member be positioned so that pressure may be sensed in the manner described herein.

As will be understood by those of skill in the art based on the description herein, pressure/vacuum sensor 1112 is electrically connected to monitoring unit 802 in a manner similar to what was described in connection with the background embodiments, with monitoring unit 802 providing novel functions as described herein.

Figure 11A:
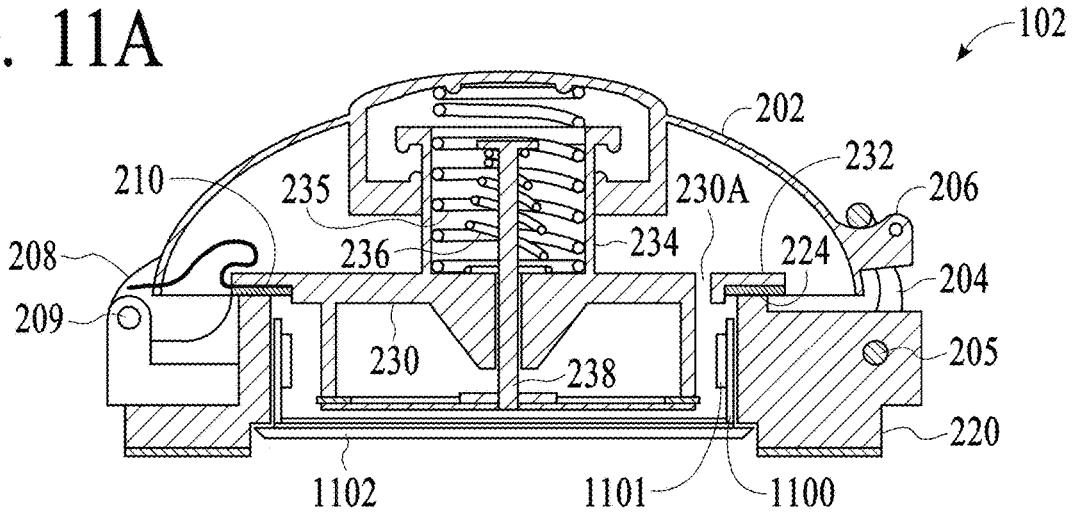
FIGS. 11A-11C are diagrams depicting an illustrative isolation seal enabling pressure and vent calibration/assessment in an exemplary tank environment.
Figure 11B:
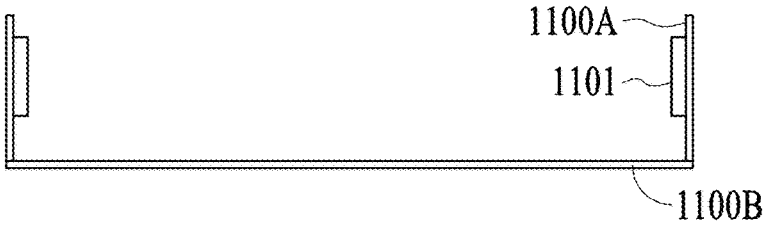
Figure 11C:
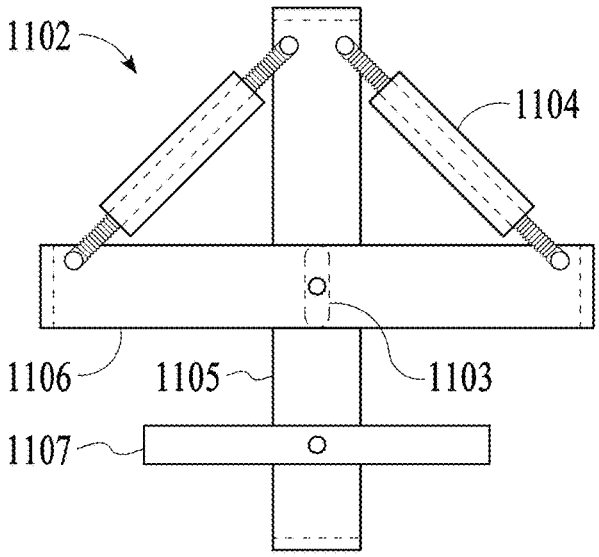

Referring now to FIGS. 11A-11C, exemplary preferred embodiments of the isolation seal will now be described. In general, isolation seal assembly 1100 consists of base bracket assembly 1102, a seal gasket consisting of seal side walls 1100A and seal base 1100B (see FIG. 11B), and expansion clamp 1101, which acts like a reverse hose clamp, expanding to engage the side wall of the hatch flange base. FIG. 11A illustrates a typical hatch with the isolation seal installed. FIG. 11B illustrates in greater detail elements of the isolation seal, for purposes of explanation and clarity.

In general, the isolation seal is installed with the hatch in the open position. Base bracket 1102 is inserted into the throat of the hatch toward the very bottom with the slotted adjustment in the middle. While holding brace bracket 1102 in place, turnbuckles 1104 are turned, which results in expansion of brace bracket 1102 by pulling cross piece 1106 having sharp ends towards the end. Cross piece 1106 preferably has beveled ends that engage the side wall of the hatch flange, and with a wrench turnbuckles 1104 are tightened to firmly engage base bracket 1102 to the side walls of hatch flange and fix it in place. With base bracket 1102 in place, the seal gasket consisting of seal side walls 1100A and seal base 1100B are positioned so as to rest on secured base bracket 1102. Expansion clamp 1101 is placed into the seal gasket and tightened so that expansion clamp 1101 expands and causes a seal to form against the side while of the hatch throat. The above implements being exemplary; what is important is that a temporarily affixed floor with a seal is positioned inside the flange of the hatch so that external air pressure may be applied, and a calibration procedure may be carried out to characterize the hatch in terms of the tank pressure at which a vent condition begins.

As will be appreciated from the foregoing, monitoring unit 802 may generate and transmit one or more alarms, including notifications and transmissions of the type described herein. Such alarms may include, for example, a status corresponding to a begin of vent condition, a status corresponding to being in a vent condition in a first range of flow levels, a status corresponding to being in a vent condition in a second range of flow levels, duration of vent conditions in the first and/or second range of flow levels, a status corresponding to the tank being in a condition of vacuum, alarms corresponding to volume of gas emitted, electronic status such as battery level or electrical operating parameters, system power up or reset conditions, etc. Other alarms are within the scope of the present invention, including combinations of alarms and customer/application specific defined alarms. What is important is that vent conditions are detected, and gas flows estimated/calculated, with parameters and values monitored and recorded and usable by monitoring unit 802 to generate alarms.

It also should be noted that, in certain alternative preferred embodiments, pressure/vacuum sensor 1112 is provided, and force sensor 602 is not utilized. In such alternative embodiments, internal tank pressure readings and preferred estimated orifice size (based on such pressure readings and for example the imputed orifice size in the pressure-CFM lookup table) are used to estimate flow in the lower range of flow levels. All such preferred and alternative embodiments are within the scope of the present invention.

As will be appreciated from the foregoing, methods of estimating/calculating the amount of gas vented are provided, with some combination of steps such as: determining a first internal tank pressure at which a vent condition begins; estimating a vent orifice size, which may be based on tank pressure data, force sensor data or both tank pressure data and force sensor data; estimating/calculating the amount of gas vented based on the tank pressure data and estimated orifice size; estimating/calculating the amount of gas vented based on stored data values when the tank pressure reaches (or exceeds) a second internal tank pressure; determining from the stored data values an estimate of orifice size when the tank pressure is at the second internal tank pressure; determining orifice sized based on the estimate of orifice size when the tank pressure is at the second level and also based on the tank pressure and/or based on force sensor readings; estimating/calculating the amount of gas vented in a first range of flow levels when the tank pressure is at or above the first internal tank pressure but below the second internal tank pressure, and estimating/calculating the amount of gas vented in a second range of flow levels when the tank pressure is at or above the second internal tank pressure; generating alarms based in whole or part based on estimates of gas flow, tank pressure, tank vacuum and other conditions as described herein. What is important is that inventive methods are provide based on the exemplary preferred embodiments herein described.

Figure 13A:
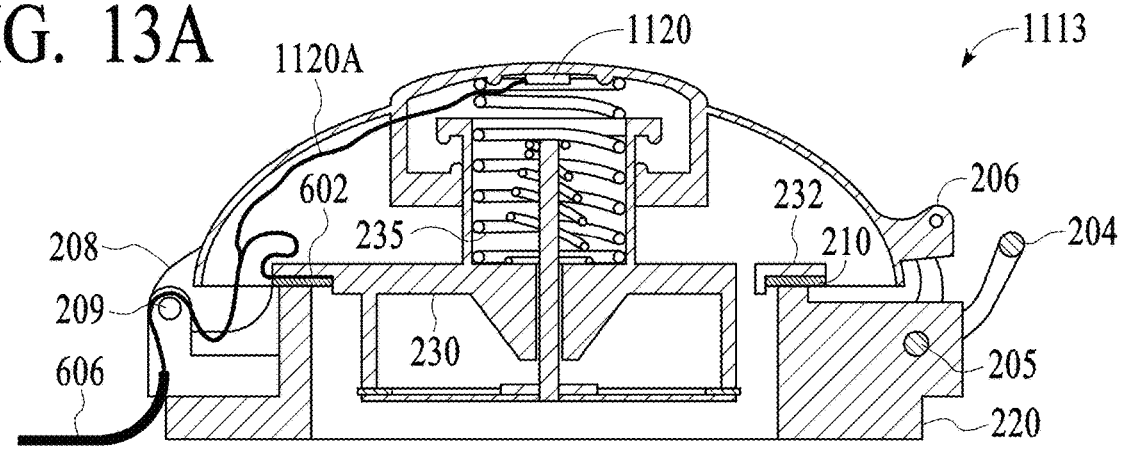
FIGS. 13A-13C are diagrams depicting preferred embodiments of force sensors being positioned proximate to exemplary spring 235, away from sealing surfaces on thief hatch.
Figure 13B:
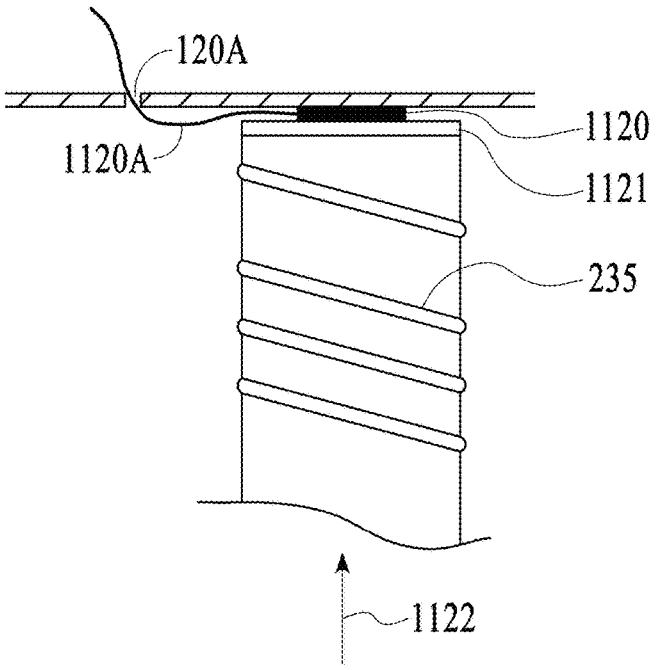
Figure 13C:
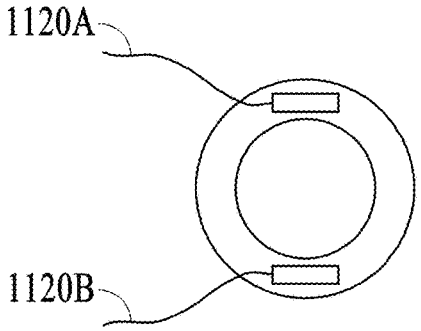

As previously described, in certain background embodiments force sensor 602 is positioned between lower sealing ring 224 and upper sealing ring 232 so as to measure force on pressure gasket 210. In certain preferred embodiments herein, force sensor 602 is not used. As force sensor 602 could impact the operation of pressure gasket 210, and also be subject to wear, contamination and other effects as described elsewhere herein, in certain preferred embodiments spring force sensor 1120 is implemented to measure force presented by spring 235. Spring force sensor 1120 (see FIGS. 13A-13C) may be positioned to detect force from spring 235 on lid 202. Spring force sensor 1120, either one or a plurality of sensors as illustrated in FIG. 13C may desirably be utilized to detect and measure hatch status for open, closed, latched, and force on gasket to create a seal, in a manner analogous to what has been described with reference to force sensor 602 (such description is incorporated herein with the description of force sensor 1120).

As will be appreciated from the description herein, springs come in many forms and are used in many different applications. A force sensor can be used to detect spring state, compression or tension, and quantify it by placing the sensor at an appropriate point in the assembly. Several examples of spring types are: compression, tension, and leaf (like bar stock). Additionally, the material may not be a spring or metal but instead could be a material attached to a moveable component like a hatch cover that would create a force as it is bolted down. This could be as simple as a tab welded on the side of the cover pushing against a non-moveable area (such alternative embodiments are described hereinafter).

Previous description herein discusses how to use a force sensor between two surfaces or landing rings as they close together to determine at what point there is enough force to create a seal. The area where this occurs can often be a dirty or corrosive environment. The environment could make it challenging for the sensor to operate well. For example, there are many petrochemicals and/or corrosive materials that may cause the sensor to fail quickly. Additionally, it may be difficult to get the sensor inserted between the mating surfaces. Force sensors at sealing surfaces such as previously described provide advantages but also have such drawbacks.

The design of vessels, tanks, etc., that hold these materials typically includes a hatch or access point on top of the vessel that allows viewing and measuring the material in the tank. Instead of placing the sensor at the sealing area, in alternative preferred embodiments a sensor is positioned at the end of a spring that is used to provide force for the seal. Often the hatch has an internal compression spring that exerts pressure on the sealing surfaces to form a seal when the hatch is closed and latched. The sensor could be placed at either end of the spring. FIGS. 13A and 13B illustrate force sensor 1120 at the top portion of spring 225, which is used to provide force to create the sealing between sealing surfaces 224 and 232, as previously described. FIG. 13B provides a closer view of spring 1120 in such an embodiment. As will be appreciated, such a force sensor could be used in lieu of force sensor 602 and avoid drawbacks of force sensor 602, while taking advantage of benefits of such a force sensor in detecting hatch open/closed not latched/closed and latched status. As will be appreciated, wire 1120A from force sensor 1120 may extend from opening 120A in lid 202 for connection to monitoring unit 802, and sealed as may be desired with a sealant to protect the wire and prevent moisture or contaminants from entering into the hatch.

Figure 14A:
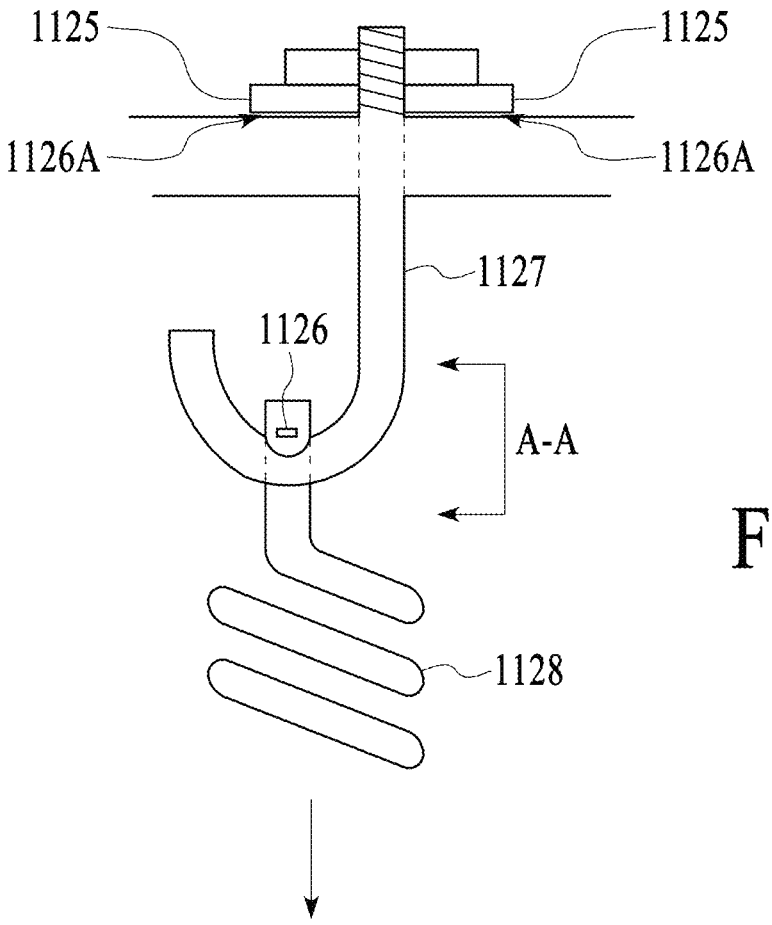
FIGS. 14A and 14B are diagrams depicting force sensors being positioned proximate to exemplary tension springs as used in certain alternate preferred embodiments.
Figure 14B:
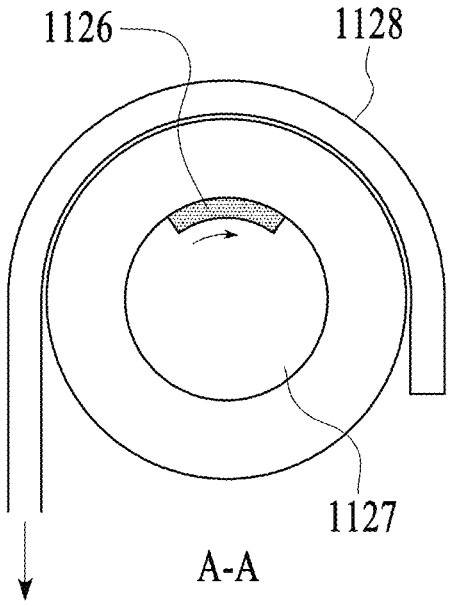

This inventive force sensor-spring embodiments are applicable in other environments than the compression spring-hatch sealing embodiments herein. For example, for a spring in tension (see spring 1128 in FIGS. 14A and 14B) sensors 1126A or 1126 may be positioned in a way to capture the force between the spring and mounting area. For example, there may be hook 1127 built into the spring mounting arrangement. The sensor may be placed between the anchored area and where the hook of the spring lands as in FIG. 14B. When necessary, fixture 1125 can be used to provide consistency across the point of contact. Measuring force in this way can be directly calibrated to the amount of pressure applied to the system being measured and thus anything connected/related to the spring. See FIGS. 14A and 14B with respect to such embodiments.

In other applications such as tanker cars or rail cars there could be a leaf spring attached to the hatch. See FIGS. 15A-15C. As the hatch closes it causes a compressive force both under the landing foot of the leaf spring or where the spring is anchored to the hatch cover.

Figure 15A:
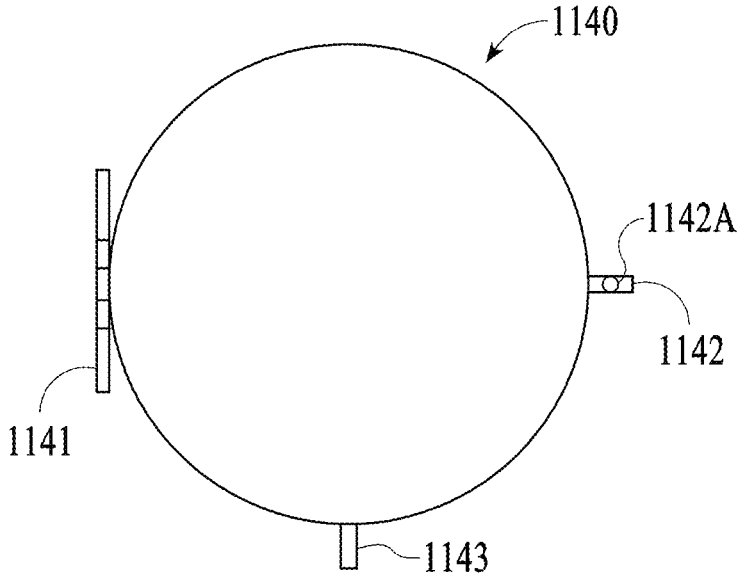
FIGS. 15A-15C are diagrams depicting force sensors being positioned proximate to exemplary leaf springs as used in certain other alternate preferred embodiments.
Figure 15B:
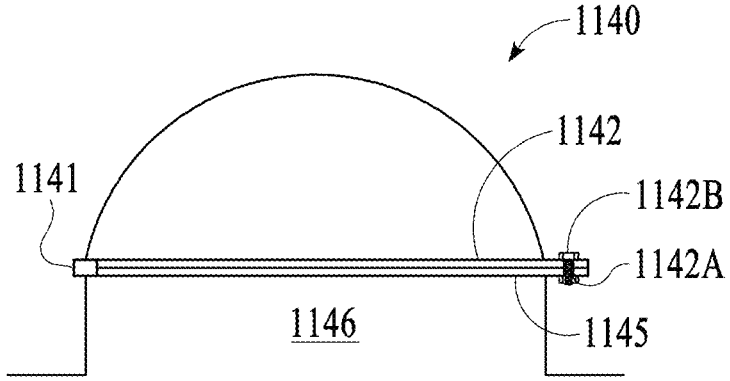

FIGS. 15A-B shows the top view of an exemplary domed cover on for example a rail tank car. Domed cover assembly 1140 includes hinge 1141 on one side (left side in FIG. 15A) with latch lug 1142 opposite hinge 1141 that preferably includes a bolt or locking mechanism to fit through a hole in latch lug 1142 and lug landing area 1145. Thus, with a visual inspection one can see whether the cover is properly closed and secured either with a lock or a bolt. Leaf spring 1143 depicts a leaf type spring that is further shown in FIG. 15C. Functionally, leaf spring 1143 can be placed anywhere along the circumference of cover assembly 1140.

FIG. 15B shows a side view of cover assembly 1140. Tank 1146 depicts the internal area of a tank on which cover assembly 1140 is mounted on or is associated with. Leaf spring 1143 is not pictured for clarity, and only showing lug 1142

Figure 15C:
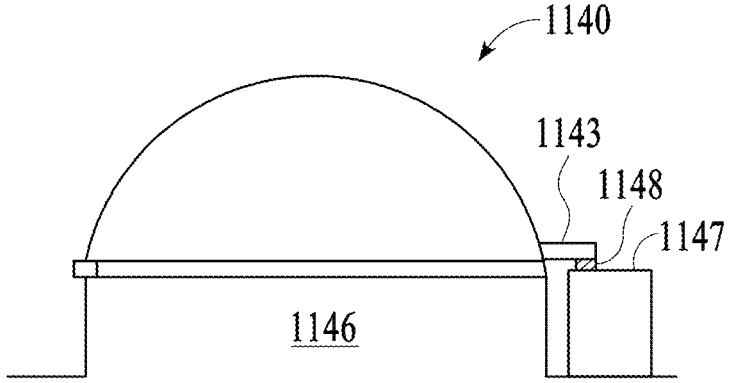

FIG. 15C is cover assembly 1140 rotated 90 degrees to show the landing area for leaf spring 1143. Leaf spring 1143 lands on landing area 1147. Landing area 1147 is shown as a block but could be any surface or structure on which leaf spring 1143 may land in a preferably even manner. Between landing area 1147 and leaf spring 1143 force sensor 1148 is placed. As cover assembly 1140 moves into a closed state, force is applied to force sensor 1148. Leaf spring 1143 allows the necessary flex as pressure increases in the secured state to avoid damage to force sensor 1148. What is important is that leaf spring 1143 applies force to force sensor 1148 (without damaging force sensor 1148) such that force sensor readings can be used to determine when the cover assembly is secured.

Figure 16A:
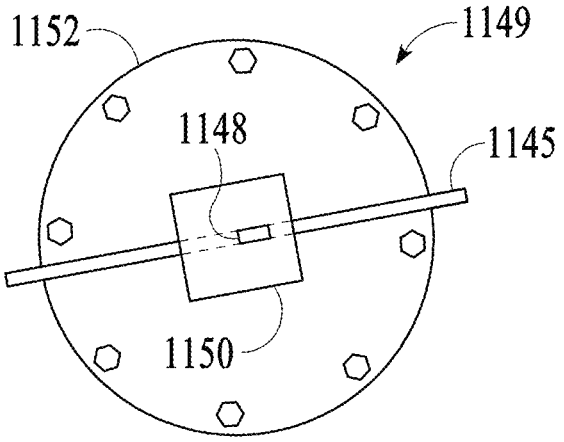
FIGS. 16A-16C are diagrams depicting force sensors being positioned proximate to other exemplary leaf springs as used in certain other alternate preferred embodiments.
Figure 16B:
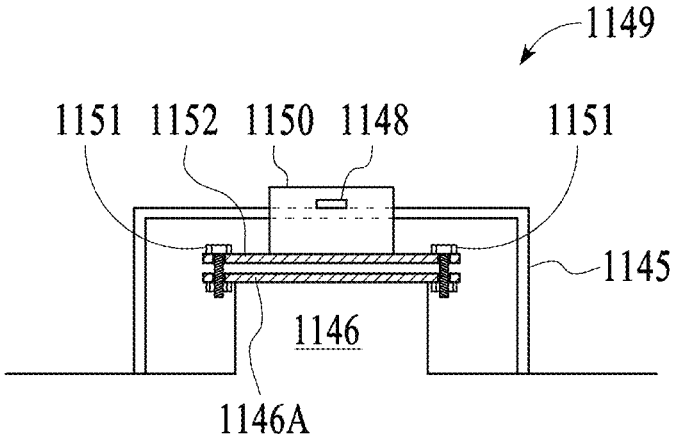
Figure 16C:
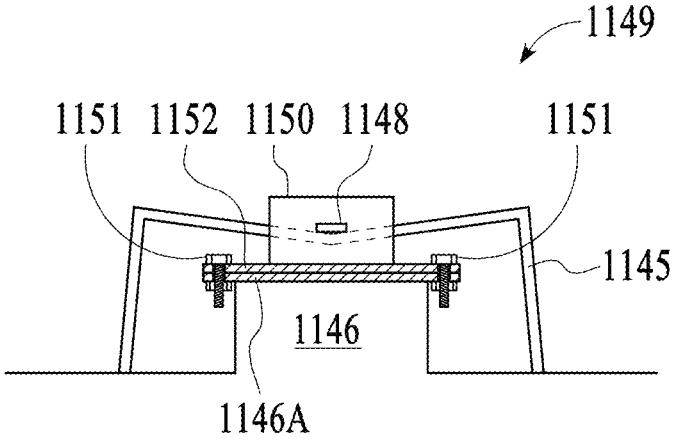

FIGS. 16A-C depict a larger diameter top and side view bolted cover 1149 that is bolted in place on tank 1146, having tank opening flange 1146A. In the previously described background embodiments, a description was provided regarding how multiple force sensors could be placed around the circumference to measure force on gasket for proper seal (see, e.g., FIG. 9B). The additional exemplary preferred embodiment illustrated in FIGS. 16A-C also uses a force sensor. In this embodiment, the force is applied through spring legs 1145 that extend to the tank top with force sensor 1148 positioned in the middle, and preferably near the center such as is illustrated. Sensor housing assembly 1150 is anchored to tank cover 1152. As tank cover bolts 1151 are tightened, tank cover 1152 moves downward toward tank opening flange 1146A. When spring legs 1145 engage the top of the tank, force is generated upward into force sensor 1148. FIG. 16B shows tank cover 1152 before the bolts are tightened (illustrated by the gap between tank cover 1152 and tank opening flange 1146A. FIG. 16C illustrates tank cover 1152 being moving to engage tank opening flange 1146A after the bolts are tightened. Note that a gasket or seal may be positioned between tank cover 1152 and tank opening flange 1146A, which may be similar to gasket 210 described elsewhere herein. It should be noted that spring leg 1145 bows or has a flex when the tank cover moves downward, putting pressure on sensors 1148. Further, in preferred embodiments, spring legs 1145 pivot around force sensor 1148, thus allowing spring legs 1145 to seek their own alignment on the tank top and create a more normalized force on sensor 1148. What is important is that spring legs 1145 provide pressure on force sensor 1148 when tank cover 1152 is bolted down on tank opening flange 1146A, such that force sensor 1148 can detect increased force indicative of tank cover 1152 being bolted down onto tank opening flange 1146A.

As will be appreciated by those of skill in the art, springs with force sensors used in preferred embodiments of the present invention can be in any equipment or device and applied in many ways, and such uses are expressly within the scope of the present invention.

The present invention has been described in terms of a thief hatch disposed on a terrestrial storage tank for simplifying the explanation and description. However, the present invention may be implemented on virtually any hatch with a cover and seal or gasket. Moreover, the hatch may be disposed on any tank, terrestrial, truck, rail, marine or airborne. Furthermore, the hatch need only be attached to a chamber or compartment of some sort, such as a diving chamber, molding/process chamber, ships compartment, aircraft compartment, space, deep sea, etc. Moreover, the invention need not be related to the control of VOC emissions or any other environmental application.

The exemplary embodiments described below were selected and described in order to best explain the principles of the invention and the practical application, and to enable others of ordinary skill in the art to understand the invention for various embodiments with various modifications as are suited to the particular use contemplated. The particular embodiments described below are in no way intended to limit the scope of the present invention as it may be practiced in a variety of variations and environments without departing from the scope and intent of the invention. Thus, the present invention is not intended to be limited to the embodiment shown, but is to be accorded the widest scope consistent with the principles and features described herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

What is claimed is:

1. A system for monitoring leakage from a storage vessel having a hatch and a hatch cover, comprising:

a tubular member in flow communication with the interior of the storage vessel;

a pressure sensor connected to a first portion of the tubular member for sensing pressure in the interior of the storage vessel; and a monitoring unit receiving data from the pressure sensor;

wherein when pressure in the interior of the storage vessel reaches a first pressure level, a state corresponding to beginning of a vent condition is recorded by the monitoring unit.

2. The system of claim 1, wherein a first range of flow levels is determined based on sensing pressure in the interior of the storage vessel being above the first pressure level and below a second pressure level, wherein the volume of gas flowing from the storage vessel is estimated based at least in part on the data received by the monitoring unit from the pressure sensor.

3. The system of claim 2, wherein when pressure in the interior of the storage vessel equals or exceeds the second level, a second range condition of vent is determined, wherein the volume of gas flowing from the storage vessel is estimated based at least in part on a set of pressure-flow rate values.

4. The system of claim 1, wherein the pressure sensor senses positive pressure and vacuum pressure conditions of gaseous pressure in the storage vessel, wherein the monitoring unit creates data indicative of the storage vessel being in a condition of positive pressure or vacuum relative to ambient atmospheric pressure.

5. The system of claim 4, wherein the monitoring unit generates one or more alarms audibly, visually or in a form for transmission to a remote location.

6. The system of claim 5, wherein the alarms include one or more alarms selected from: a status corresponding to a begin of vent condition, a status corresponding to being in a vent condition in a first range of flow levels, a status corresponding to being in a vent condition in a second range of flow levels, duration of vent conditions in the first and/or second range of flow levels, a status corresponding to the tank being in a condition of vacuum, alarms corresponding to volume of gas emitted, electronic status such as battery level or electrical operating parameters, system power up or reset conditions.

7. The system of claim 1, wherein the condition of vent is determined by comparison of the pressure in the interior of the storage vessel with a calibration pressure value.

8. The system of claim 7, wherein the calibration pressure value is determined by:

removably securing an isolation sealing element in the hatch, wherein space is determined by the isolation sealing element and the hatch cover;

applying pressurized air external from the hatch cover into a second portion of the tubular member, wherein the pressurized air pressurizes the space determined by the isolation sealing element and the hatch cover;

measuring pressure and flow rate of pressurized air into the second portion of the tubular member, wherein based on measured flow rate a pressure is determined at which the condition of vent is detected; and recording the calibration pressure value at which the condition of vent is detected.

9. The system of claim 8, wherein the isolation sealing element comprises an expandable seal that expands and contacts a side wall of the hatch.

10. The system of claim 9, wherein the isolation sealing element is positioned on a removably securable expanding bracket, wherein the expanding bracket expands and engages the side wall of the hatch.

11. The system of claim 1, wherein the monitoring unit measures force from a force sensor, and the measured force corresponds to force exerted by the hatch cover onto the hatch.

12. The system of claim 11, wherein the force sensor is positioned between a sealing surface of the hatch and a sealing surface of the hatch cover.

13. The system of claim 12, wherein the force sensor is positioned proximate to an end of a hatch sealing spring, wherein the hatch sealing spring is compressed when the hatch cover is secured to the hatch.

14. The system of claim 13, wherein the force sensor is positioned proximate to a top most end of the hatch sealing spring.

15. The system of claim 11, wherein a plurality of force sensors are provided to measure spring compression force of the hatch sealing spring.

16. A system for detecting compression/tension status of a spring, comprising:

a spring with a mating surface positioned proximate to a compression/tension member;

a force sensor positioned between the mating surface of the spring and a surface of the compression/tension member, where data or signals are output by the force sensor that correlate the compression/tension state of the spring; and a monitoring unit receiving data or signals output by the force sensor, wherein data indicative of the compression or tension status of the spring are generated by the monitoring unit.

17. The system of claim 16, wherein the compression/tension member comprises a rigid surface against which the spring applies force when the spring is in compression or tension.

18. The system of claim 16, wherein the spring is positioned in a hatch cover on a storage vessel, wherein the data indicative of hatch cover open/close/latch status is determined based on the data indicative of the compression or tension status of the spring.

19. The system of claim 16, wherein the compression/tension member comprises a hook member on which the spring is positioned, wherein the force sensor is positioned between the mating surface of the spring and a corresponding surface on the hook member against which the spring applies force when the spring is in tension.

20. A system for detecting compression/flex status of a leaf spring, comprising:

a leaf spring with a mating surface positioned proximate to a sensing surface;

a force sensor positioned between the mating surface of the leaf spring and the sensing surface, where data or signals are output by the force sensor that correlate to the compression/flex state of the leaf spring; and a monitoring unit receiving data or signals output by the force sensor, wherein data indicative of the compression/flex status of the leaf spring are generated by the monitoring unit.

* * * * *